US011965400B2

(12) United States Patent
Green

(10) Patent No.: US 11,965,400 B2
(45) **Date of Patent: *Apr. 23, 2024**

(54) SYSTEM AND METHOD TO MAINTAIN MINIMUM WELLBORE LIFT CONDITIONS THROUGH INJECTION GAS REGULATION

(71) Applicant: Well Master Corporation, Golden, CO (US)

(72) Inventor: David A. Green, Highlands Ranch, CO (US)

(73) Assignee: Well Master Corporation, Golden, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/241,970

(22) Filed: Sep. 4, 2023

(65) Prior Publication Data

US 2023/0407733 A1 Dec. 21, 2023

Related U.S. Application Data

(63) Continuation-in-part of application No. 18/097,442, filed on Jan. 16, 2023, now Pat. No. 11,746,628, which is a continuation-in-part of application No. 17/734,089, filed on May 1, 2022, now Pat. No. 11,555,387, which is a continuation of application No. 17/576,841, filed on Jan. 14, 2022, now Pat. No. 11,319,785.

(60) Provisional application No. 63/138,496, filed on Jan. 17, 2021.

(51) Int. Cl.
*E21B 43/12* (2006.01)

(52) U.S. Cl.
CPC ..... *E21B 43/121* (2013.01); *E21B 43/12* (2013.01); *E21B 2200/20* (2020.05)

(58) Field of Classification Search
CPC ..... E21B 43/212; E21B 43/12; E21B 2200/20
See application file for complete search history.

(56) References Cited

U.S. PATENT DOCUMENTS

| | | | |
|---|---|---|---|
| 5,146,991 | A | 9/1992 | Rodgers |
| 5,785,123 | A | 7/1998 | Lea, Jr. |
| 5,878,817 | A | 3/1999 | Stastka |
| 6,257,332 | B1 | 7/2001 | Vidrine |
| 7,395,865 | B2 | 7/2008 | Bender |
| 7,793,728 | B2 | 9/2010 | Bender |
| 7,891,960 | B2 | 2/2011 | Lea, Jr. |
| 8,464,798 | B2 | 6/2013 | Nadkrynechny |
| 8,627,892 | B2 | 1/2014 | Nadkrynechny |

(Continued)

OTHER PUBLICATIONS

International Searching Authority, International Search and Written Opinion, dated Mar. 30, 2022 in PCT/US2022/012643.

(Continued)

*Primary Examiner* — Brad Harcourt
(74) *Attorney, Agent, or Firm* — Critical Path IP Law, LLC

(57) ABSTRACT

A launch point lift gas velocity control system and method of use, the system operating to maintain minimal well bore lift conditions through injection gas regulation. In one aspect, the minimal wellbore conditions enable a gas-liquid mixture or a downhole tool at a selectable well bore launch point to depart from a targeted launch point lift gas velocity and ascend up the well bore. The launch point may be adjusted to account for variability with time and wellbore location.

21 Claims, 18 Drawing Sheets

(56) References Cited

U.S. PATENT DOCUMENTS

| | | | | |
|---|---|---|---|---|
| 8,863,837 | B2 | 10/2014 | Bender | |
| 8,869,902 | B2 | 10/2014 | Smith | |
| 9,297,247 | B2 | 3/2016 | Lea, Jr. | |
| 9,938,803 | B1 | 4/2018 | Lea, Jr. | |
| 10,526,877 | B1 | 1/2020 | Lea, Jr. | |
| 10,774,627 | B1 | 9/2020 | Lea, Jr. | |
| 11,746,628 | B2 * | 9/2023 | Green | E21B 43/121 166/120 |
| 2006/0054329 | A1 | 3/2006 | Chisholm | |
| 2009/0159290 | A1 | 6/2009 | Lauderdale | |
| 2012/0193091 | A1 | 8/2012 | Bender | |
| 2014/0284105 | A1 | 9/2014 | Veltman | |
| 2015/0136389 | A1 | 5/2015 | Bergman | |
| 2015/0292281 | A1 | 10/2015 | Hardin, Jr. | |
| 2018/0119692 | A1 | 5/2018 | Bangor | |
| 2020/0248521 | A1 | 8/2020 | Southard | |

OTHER PUBLICATIONS

Review, Classification and Structural Analysis of Downhole Robots: Core Technology and Prospects for Application, Robotics and Autonomous Systems, Feb. 2019, Liu.

Notice of Allowance, U.S. Appl. No. 17/576,841, dated Mar. 25, 2022.

Notice of Allowance, U.S. Appl. No. 17/734,089, dated Sep. 26, 2022.

Notice of Allowance, U.S. Appl. No. 18/097,442, dated May 25, 2023.

* cited by examiner

| | | | | | |
|---|---|---|---|---|---|
| $P_{LINE}$ | 1,000 PSI | 150 PSI | 25 PSI | 150 PSI | 25 PSI |
| $P_{BH}$ | 1,500 PSI | 1,500 PSI | 1,500 PSI | 750 PSI | 300 PSI |
| **Ratio $P_{LINE}$ : $P_{BH}$** | 1.5:1 | 10:1 | 60:1 | 5:1 | 12:1 |
| **Plunger speed at surface[1]** | 450 FPM[2] | 3,000 FPM | 18,000 FPM | 1,500 FPM | 3,600 FPM |
| **Plunger average speed[3]** | 375 FPM | 1,650 FPM | 9,125 FPM | 900 FPM | 1,950 FPM |

[1] Assumes plunger break-out speed of 300 FPM at well bottom
[2] Plunger speed at surface is 300 FPM x ratio = 300 FPM x 1.5 = 450 FPM
[3] Average speed is (plunger speed at surface + break-out speed of 300 FPM) / 2

Fig. 6

SYSTEM AND METHOD TO MAINTAIN MINIMUM WELLBORE LIFT CONDITIONS THROUGH INJECTION GAS REGULATION

CROSS-REFERENCE TO RELATED APPLICATION

This application is a continuation in part of U.S. patent application Ser. No. 18/097,442 filed Jan. 16, 2023 and titled "Multi-Stage Downhole Tool Movement Control System and Method of Use," which in turn is a continuation in part of and claims the benefit of U.S. patent application Ser. No. 17/734,089 filed May 1, 2022 and titled "Downhole Tool Movement Control System and Method of Use," which in turn is a continuation of and claims the benefit of U.S. patent application Ser. No. 17/576,841 filed Jan. 14, 2022 and titled "Downhole Tool Movement Control System and Method of Use," which in turn claims the benefit of U.S. Provisional Patent Application No. 63/138,496 titled "Downhole Tool Movement Control System and Method of Use" filed Jan. 17, 2021, the disclosures of which are all hereby incorporated herein by reference in entirety.

FIELD

The present invention is directed to a system and method of use to maintain minimal wellbore lift conditions through injection gas regulation, the minimal wellbore conditions enabling a gas-liquid mixture or a downhole tool at a selectable wellbore launch point to depart from a targeted launch point lift gas at a sufficient velocity and ascend the wellbore.

BACKGROUND

Downhole tools commonly used in oil and gas wells operate within production lines of a wellbore. Some downhole tools, such as plungers, typically operate the entire length of the production line, from wellhead to bottom hole. The phrase "downhole tool" means any device inserted into a production line that freely move within a production line without a physical attachment such as a wire, cable rope, rod, etc. Since these downhole tools are designed to be free-cycling, that is, not connected to any physical guiding or driving mechanism, they are subject to pressure and fluid flow conditions in the production line of the well which may vary greatly over the depth of the well and from one well to another. (Note: Plungers may operate in tubing strings of a well, which are the most common, but plungers may also operate in casing strings of a well; the phrase "production line" means any production conduit of a well, to include tubing strings and casing strings).

During ascent, the plunger typically operates as a liquid pump to bring fluid (aka "plunger lift") to the wellhead to increase operating performance of the well. The term "fluid" means a substance devoid of shape and yields to external pressure, to include liquids and gases, e.g., water and hydrocarbons in liquid or gaseous form, and combinations of liquids and gases.

A plunger is often arranged to travel upward within a preferred average speed range, if not at a preferred speed value, to most effectively bring fluid to the wellhead. Typically, plungers are operated in a widely varying speed range due to, for example, a lack of plunger location data within the tubing string and a lack of control mechanism to slow or accelerate the plunger. At best, the plunger may be operated to achieve an average speed during ascent, an average which frequently includes operating tranches of ineffectively high or low speed that do not support efficiency of the intended fluid lift. A plunger operating at too slow a speed allows gas to slip past the plunger and can result in a plunger stalling before reaching the wellhead. In some situations, the plunger may contact the wellhead at dangerously high speeds, resulting in plunger damage, surface lubricator damage, wellhead damage and, on occasion, breach of the wellhead. Examples of plunger speeds under various well conditions is provided with respect to FIG. 6.

In a multi-stage plunger lift operation, a set of plungers are positioned in a tubing string, each plunger separated from the next by a partitioning tool and defining tubing string partitions or tubing string stages. The partitioning tool receives accumulated fluids from its adjacent deeper plunger, the accumulated fluids passing through the partitioning tool and serviced by adjacent shallower plunger. Such a configuration, in which smaller accumulated fluid loads are carried yet at greater frequency, can result in increased efficiency and/or reduced energy expenditure of the overall fluid lift operation.

The ideas and concepts of single and multi-stage plunger lift operations may be applied to maintain or control minimal wellbore lift conditions through injection gas regulation. Such minimal wellbore conditions may enable a gas-liquid mixture or a downhole tool at a selectable wellbore launch point to depart from a targeted launch point lift gas velocity in a free-cycle environment.

(Note that the terms "speed" and "velocity" are used interchangeably in the disclosure, e.g., such as in the phrases "plunger speed" and "plunger velocity" and "fluid speed" and "fluid velocity," to mean the rate of movement in a defined space, e.g., plunger speed means the rate of movement of a plunger within a production line).

What is needed is a system and method to control the ascent (or descent, aka fall) speed of one or more plunger tools when rising (or falling) within a production line of a wellbore and, in some embodiments, to control the stop location of a plunger at a selected downhole position within a production line. Furthermore, what is needed is a system that can maintain minimal wellbore lift conditions through injection gas regulation.

SUMMARY

A downhole tool movement control system to control the ascent (or fall) speed of a plunger tool when rising (or falling) within a production line of a wellbore is disclosed, the system capable of operating as a single stage system with one plunger or as a multi-stage system operating on a set of plungers. The benefits of such a system and method of use include increased fluid lift efficiency, increased well productivity, increased plunger life, and increased safety.

The system and method are applicable to any free-traveling downhole tool used in a production line and is specifically not limited to plungers. For example, the system and method of use may be used to control the movement of any downhole tool placed within a production line during any phase of a wellbore, to include during well drilling, well formation and evaluation, well intervention, well servicing, well data collection and/or datalogging, well completion and oil and gas production.

The disclosure also provides several embodiments of multi-stage downhole tool movement control systems and methods of use.

Furthermore, the disclosure provides several embodiments of a system and method to maintain minimal wellbore lift conditions through injection gas regulation, the minimal wellbore conditions enabling a gas/liquid mix or a downhole tool at a selectable wellbore launch point to begin and maintain a targeted velocity in a free-cycle environment.

In one embodiment, a method of controlling a launch point lift gas velocity of a gas-liquid mixture at a launch point location of a production string of a well casing is disclosed, the method comprising: identifying the launch point location within the production string, the production string disposed within a well bore and configured to allow the gas-liquid mixture to travel within the production string, the production tubing string in fluid communication with a hydrocarbon deposit and having a set of well parameters comprising a first set of well parameters; providing a system control device in fluid communication with the production string and having a set of system control device settings comprising an initial system control device setting; providing a system controller comprising a computer processor, the computer processor having machine-executable instructions operating to: receive the first set of well parameters; receive the initial system control device setting; receive the launch point location; determine a launch point lift gas velocity at the launch point location based at least on the first set of well parameters, the launch point lift gas velocity enabling the gas-liquid mixture adjacent the launch point location to depart the launch point location; determine an adjusted system control device setting that establishes the launch point lift gas velocity at the launch point location; communicate the adjusted system control device setting to the system control device; and adjust the system control device to the adjusted system control device setting from the initial system control device setting; wherein: the gas-liquid mixture adjacent the launch point location departs the launch point location as a launched gas-liquid mixture that achieves the launch point lift gas velocity.

In one aspect, the launched gas-liquid mixture ascends the production string without further adjustment of the system control device. In another aspect, the production string has a first production string section and a second production string section; the first production string section is associated with a wellhead portion of the production string and the second production string section is associated with a bottom hole assembly; the launch point location is within the second production string section; and the launched gas-liquid mixture ascends the production string from the second production string section to the first production string section without further adjustment of the system control device. In another aspect, the system control device is an annulus injection valve regulating gas injection into a production string annular space, and the production string is one of a tubing string and a casing string. In another aspect, the set of system control device settings determine a set of system control valve flow rates for a plurality of system control valves. In another aspect, the set of well parameters include at least one of a production string inner diameter, a production string pressure, a line pressure, a gas rate, a liquid/gas ratio, and a depth to a bottom hole assembly. In another aspect, the set of well parameters include at least one of a pressure in the first production string section, a pressure in the second production string section, and a bottom hole pressure. In another aspect, the method further comprises the steps of: providing a downhole tool operating within the production string, the downhole tool having a set of downhole tool parameters; and positioning the downhole tool adjacent or within the gas-liquid mixture. In another aspect, the downhole tool ascends the production string without further adjustment of the system control device. In another aspect, the launch point location is at a distal location of the production string substantial near the terminus of the production string; the launched gas-liquid mixture ascends the production string without further adjustment of the system control device; and the system control device is a system control valve.

In another embodiment, a launch point lift gas velocity control system is disclosed, the system comprising: a system controller comprising a system processor, the system controller operating to control a launch point lift gas velocity of a gas-liquid mixture at a launch point location of a production string of a well casing, the gas-liquid mixture disposed within a production string fitted within a well bore, the production string configured to allow the gas-liquid mixture to travel within the production string, the production string in fluid communication with a hydrocarbon deposit and having a set of well parameters comprising a first set of well parameters; and a system control device in fluid communication with the production string and having a set of system control device settings comprising an initial system control device setting, the system control device controlled by the system controller; wherein, upon identification of the launch point location within the production string, the system processor executes machine-executable instructions to: receive the first set of well parameters; receive the initial system control device setting; receive the launch point location; determine a launch point lift gas velocity at the launch point location based at least on the first set of well parameters, the launch point lift gas velocity enabling the gas-liquid mixture adjacent the launch point location to depart the launch point location; determine an adjusted system control device setting that establishes the launch point lift gas velocity at the launch point location; communicate the adjusted system control device setting to the system control device; and adjust the system control device to the adjusted system control device setting from the initial system control device setting; wherein: the gas-liquid mixture adjacent the launch point location departs the launch point location as a launched gas-liquid mixture that achieves the launch point lift gas velocity.

In one aspect, the launched gas-liquid mixture ascends the production string without further adjustment of the system control device. In another aspect, the production string has a first production string section and a second production string section; the first production string section is associated with a wellhead portion of the production string and the second production string section is associated with a bottom hole assembly; the launch point location is within the second production string section; and the launched gas-liquid mixture ascends the production string from the second production string section to the first production string section without further adjustment of the system control device. In another aspect, the system control device is an annulus injection valve regulating gas injection into a production string annular space, and the production string is one of a tubing string and a casing string. In another aspect, the set of system control device settings determine a set of system control valve flow rates for a plurality of system control valves. In another aspect, the set of well parameters include at least one of a production string inner diameter, a production string pressure, a line pressure, a gas rate, a liquid/gas ratio, and a depth to a bottom hole assembly. In another aspect, the production string is further configured to engage a downhole tool operating within the production string, the downhole tool having a set of downhole tool parameters and positioned adjacent or within the gas-liquid mixture. In another aspect, the downhole tool ascends the production string without further adjustment of the system control device. In another aspect, the launch point location is at a distal location of the production string substantial near the terminus of the production string; the launched gas-liquid mixture ascends the production string without further adjustment of the system control device; and the system control device is a system control valve.

In yet another embodiment, a launch point lift gas velocity control system is disclosed, the system comprising: a system controller comprising a system processor, the system controller operating to control a launch point lift gas velocity of a sequence of gas-liquid mixtures at a launch point location of a production string of a well casing, the sequence of gas-liquid mixtures disposed within a production string fitted within a well bore, the production string configured to allow the sequence of gas-liquid mixtures to travel within the production string, the production string in fluid communication with a hydrocarbon deposit and having a set of well parameters comprising a first set of well parameters and having a first production string section associated with a wellhead portion of the production string; and a system control device in fluid communication with the production string and having an initial system control device setting, the system control device controlled by the system controller; wherein, upon identification of the launch point location within the production string, the system processor executes machine-executable instructions to: receive the first set of well parameters; receive the initial system control device setting; receive the launch point location; determine a first launch point lift gas velocity at the launch point location based at least on the first set of well parameters, the first launch point lift gas velocity enabling a first gas-liquid mixture of the sequence of gas-liquid mixtures adjacent the launch point location to depart the launch point location; determine a first adjusted system control device setting that establishes the first launch point lift gas velocity at the launch point location; communicate the first adjusted system control device setting to the system control device; and adjust the system control device to the first adjusted system control device setting from the initial system control device setting; wherein: the first gas-liquid mixture adjacent the launch point location departs the launch point location as a first launched gas-liquid mixture that achieves the first launch point lift gas velocity; upon the first launched gas-liquid mixture reaching the first production string section, the system processor executes machine-executable instructions to: determine a second launch point lift gas velocity at the launch point location, the second launch point lift gas velocity enabling a second gas-liquid mixture of the sequence of gas-liquid mixtures adjacent the launch point location to depart the launch point location; determine a second adjusted system control device setting that establishes the second launch point lift gas velocity at the launch point location; communicate the second adjusted system control device setting to the system control device; and adjust the system control device to the second adjusted system control device setting; wherein: the second gas-liquid mixture adjacent the launch point location departs the launch point location as a second launched gas-liquid mixture that achieves the second launch point lift gas velocity.

In one aspect, the system processor executes machine-executable instructions to: periodically determine revised launch point lift gas velocity at the launch point location, the revised launch point lift gas velocity enabling a subsequent gas-liquid mixture of the sequence of gas-liquid mixtures adjacent the launch point location to depart the launch point location; determine a revised adjusted system control device setting that establishes the revised launch point lift gas velocity at the launch point location; communicate the revised adjusted system control device setting to the system control device; and adjust the system control device to the revised adjusted system control device setting; wherein: the subsequent gas-liquid mixture adjacent the launch point location departs the launch point location as a subsequent launched gas-liquid mixture that achieves the revised launch point lift gas velocity.

For a more detailed description of plungers see, e.g., U.S. Pat. Nos. 7,395,865 and 7,793,728 to Bender; U.S. Pat. No. 8,869,902 to Smith et al; and U.S. Pat. Nos. 8,464,798 and 8,627,892 to Nadkrynechny, each of which are incorporated by reference in entirety for all purposes. For a more detailed description of wellbore operations see, e.g., U.S. Pat. No. 8,863,837 to Bender, incorporated by reference in entirety for all purposes. For a more detailed description of multi-stage plunger operations and associated partitioning tools, see, e.g., U.S. Pat. No. 7,878,251 to Giacomino, incorporated by reference in entirety for all purposes.

An "interior flow-through plunger" means any plunger in which fluid passes through at least some of an interior cavity of a plunger and including, for example, the set of plungers described in U.S. Pat. No. 11,492,863 to Southard et al, and plungers that are commonly termed "bypass plungers." U.S. Pat. No. 11,492,863 is incorporated by reference in entirety for all purposes. Note that any embodiment and/or element of the disclosure that engages with, interconnects to, or otherwise references a "bypass plunger" or a "plunger" may also more broadly engage with, interconnect to, or reference an interior flow-through plunger or other downhole tool.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The term "means" as used herein shall be given its broadest possible interpretation in accordance with 35 U.S.C., Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

BRIEF DESCRIPTION OF THE DRAWINGS

The disclosure will be readily understood by the following detailed description in conjunction with the accompanying drawings, wherein like reference numerals designate like elements. The elements of the drawings are not necessarily to scale relative to each other. Identical reference numerals have been used, where possible, to designate identical features that are common to the figures.

FIG. 6 provides data tables of calculations for various plunger operations;

It should be understood that the proportions and dimensions (either relative or absolute) of the various features and elements (and collections and groupings thereof) and the boundaries, separations, and positional relationships presented there between, are provided in the accompanying figures merely to facilitate an understanding of the various embodiments described herein and, accordingly, may not necessarily be presented or illustrated to scale (unless so stated on any particular drawing), and are not intended to indicate any preference or requirement for an illustrated embodiment to the exclusion of embodiments described with reference thereto.

DETAILED DESCRIPTION

Embodiments of a downhole tool movement control system and method of use are disclosed. The downhole tool movement control system may be referred to simply as "system" and the method of use of a downhole tool movement control system may be referred to simply as "method." The system and method of use are capable of operating as a single stage system with one downhole tool or as a multi-stage system operating on a set of downhole tools. The aspects and features of the system and method, when described as operating as a single stage system or method associated with one downhole tool, apply to the system and method when described as operating as a multi-stage system or method associated with multiple downhole tools.

Figure 7:
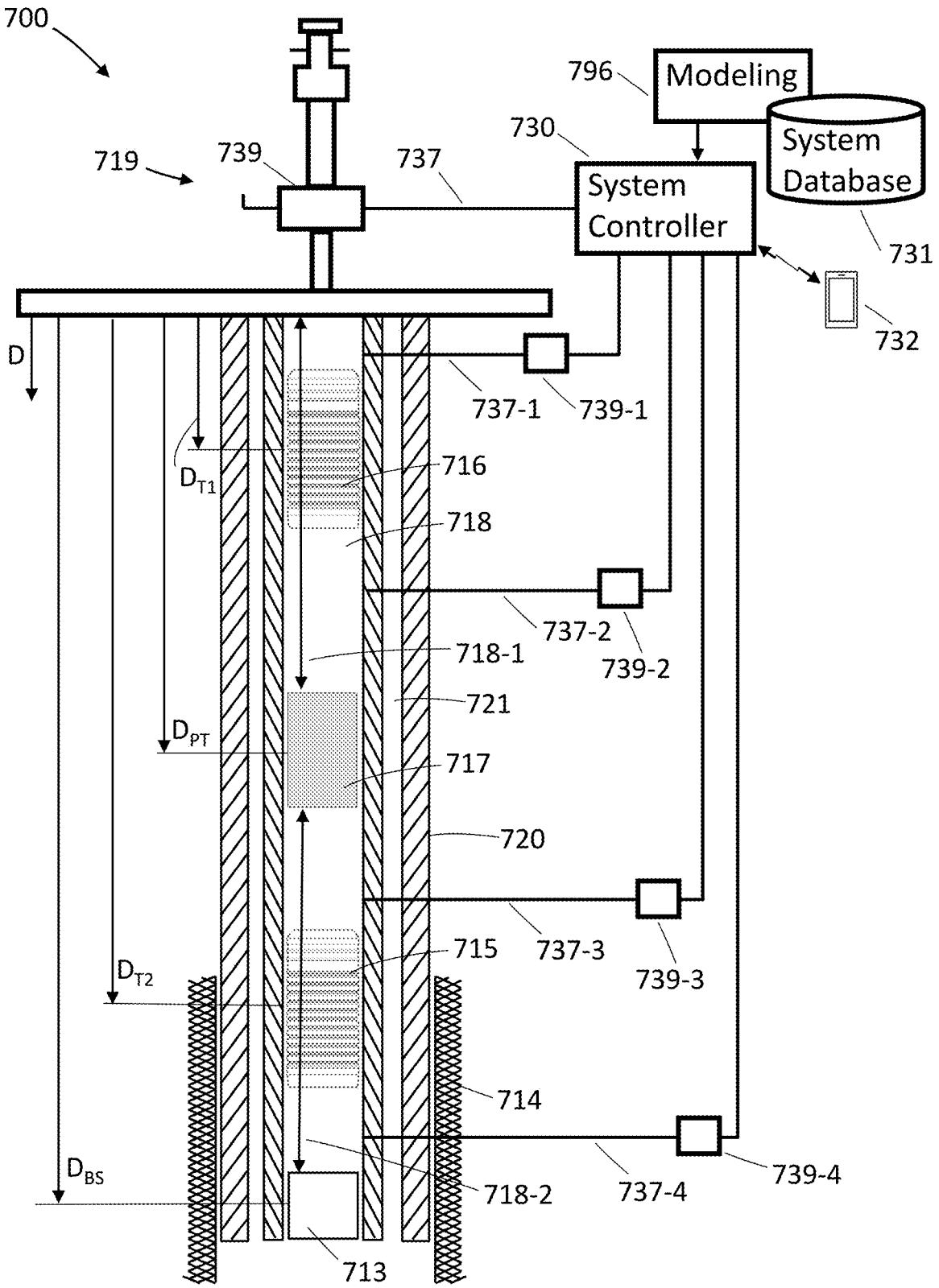
FIG. 7 depicts a side view representation of one embodiment of a multi-stage downhole tool movement control system of the disclosure.
Figure 8:
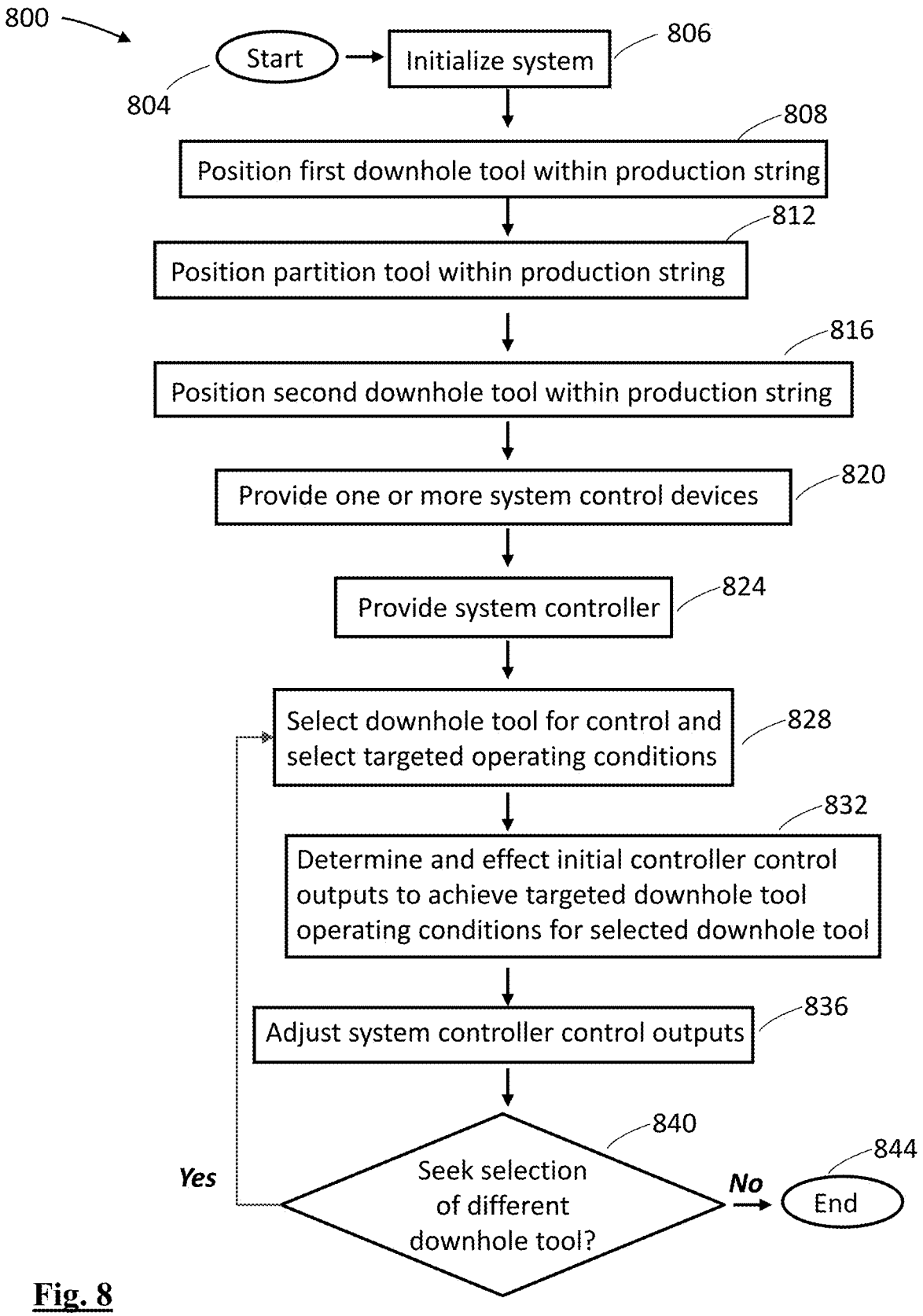
FIG. 8 depicts a flowchart of one embodiment of a method of use of the multi-stage downhole tool movement control system of FIG. 7.

Embodiments of a system and method to maintain minimal wellbore list conditions through injection gas regulation are also described, such a system and method leveraging aspects of the downhole tool movement control system and method of use. Generally, the downhole tool movement control system operates to control the movement of a downhole tool within a production line through control of at least one system valve. The system valve, controlled by way of a system controller, operates on the production line to control conditions within the production line, such as various pressures within the production line, to effect and control the movement, such as the speed/velocity, of the downhole tool. Note that the system valve refers to any flow regulating device, including variable-opening valves and automatic chokes amongst others. In one embodiment, more than one system valve is employed to control the movement, such as the speed, of the downhole tool. For example, a supplemental gas volume may be supplied to the annulus of a well wherein the gas enters the tubing string at the tubing string bottom or some other intermediate point, thereby increasing gas pressure at that position. The supplemental gas volume is controlled by one or more supplemental valves. This example is common in the field of Gas Lift and in common practices of Gas Lift or gas injection in combination with plunger lift, commonly known as Plunger Assisted Gas Lift and Gas Assisted Plunger Lift. FIGS. 1-6 describe the downhole tool movement control system when operating as a single stage system with one downhole tool. FIGS. 7-8 describe a multi-stage downhole tool movement control system operating as a multi-stage system operating on a set of downhole tools.

Figure 1A:
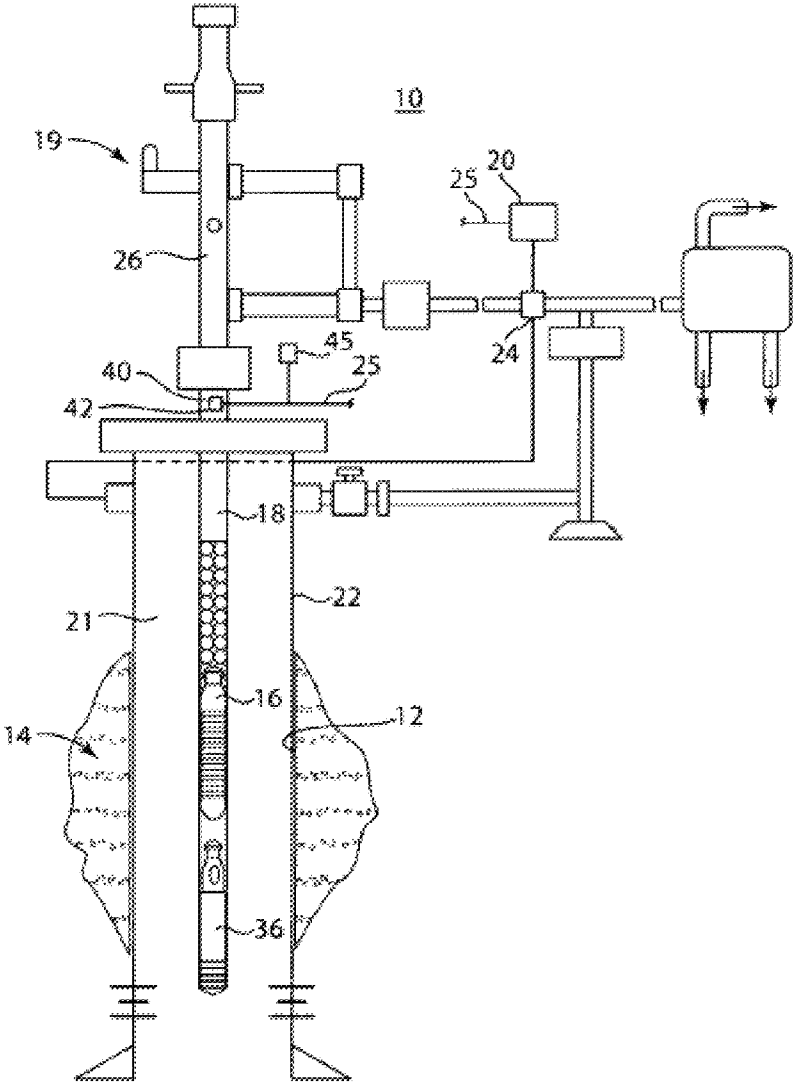
Fig. 1A (Prior Art)
FIG. 1A is a side view representation of a well production system of the prior art.

FIG. 1A is a side view representation of a well production system of the prior art. The figure is from U.S. Pat. No. 8,863,837 to Bender et al ("Bender"). The general components, and details of operation, of the well system 10 of FIG. 1 are provided in Bender and will not be extensively detailed here for brevity. Note the system valve 24, as controlled by controller 20, operating to control fluid conditions within tubing string 18 which influences plunger 16 kinematics. The term "kinematics" means a description of motion, such as the description of motion of a plunger in a tubing string, to specifically include plunger location and speed). Many of the general components of the well system 10 are similar to those of the downhole tool movement control system of the disclosure, with deliberately similar element numbers. For example, the annulus 21 of Bender's well 14 is similar to the annulus 221 and well 214 of the disclosed downhole tool movement control system 200 of FIG. 2.

Figure 1B:
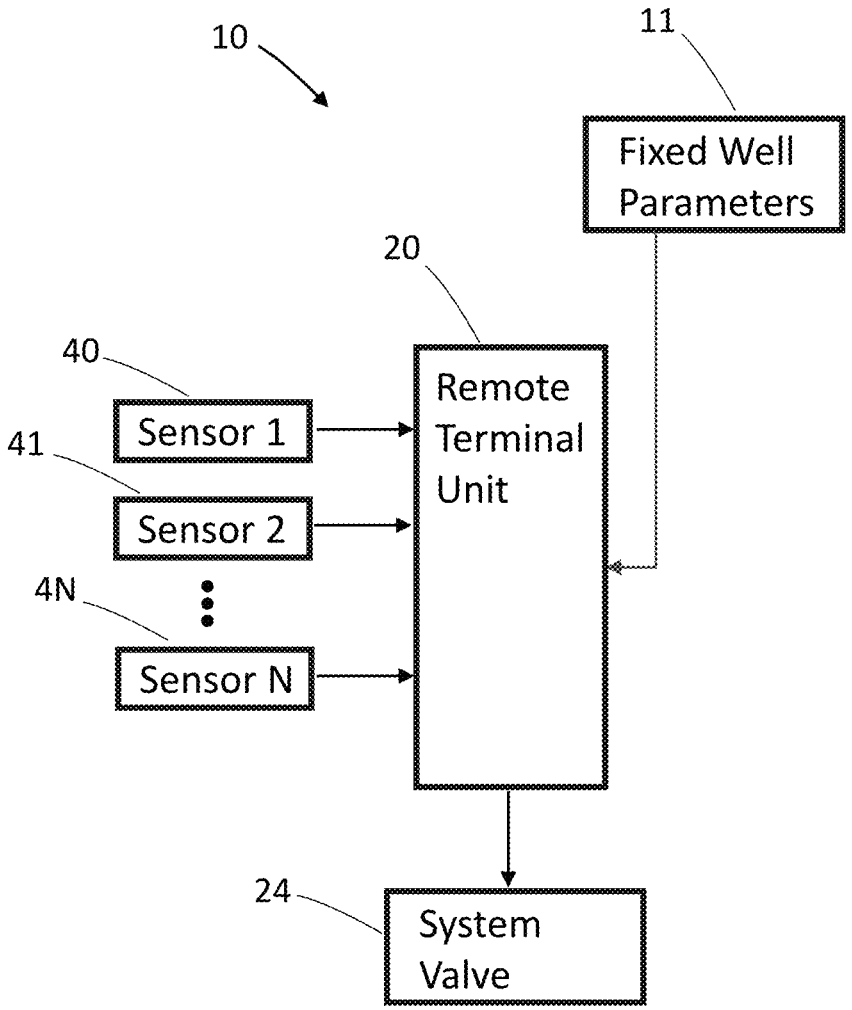
Fig. 1B (Prior Art)
FIG. 1B is a schematic block diagram of a well pressure control system of the prior art.

FIG. 1B is a schematic block diagram of a well pressure control system of the prior art, such as the well pressure control system of FIG. 1A. The computer controller 20, may be a standalone control device or one commonly termed a Remote Terminal Unit (RTU) by those skilled in the art, operates the system valve 24. The RTU (or control computer) typically receives a set of fixed well parameters and one or more sensor inputs 40, 41 through 4N to determine a setting for the system valve, such as a pressure setting in PSI. The sensor inputs may comprise a pressure value at the wellhead, depicted as sensor 40. The RTU (or control computer) may integrate with and/or interact with a Supervisory Control and Data Acquisition (SCADA) system, as known by those skilled in the art.

The fixed well parameters 11 may include one or more of tubing size (e.g., the inner diameter of the tubing), depth to the Bottom Hole Assembly (BHA), liquid/gas ratio (LGRs), gas and/or liquid properties (e.g., gas densities), plunger selection or plunger type (e.g., plunger geometries and/or notional or nominal plunger performance/kinematics), desired or targeted or selectable plunger velocity, and desired or targeted or selectable plunger maximum velocity.

In one embodiment, the set of downhole tool parameters include a set of notional downhole tool performance profiles. In one embodiment, the set of notional downhole tool performance profiles define a notional downhole tool velocity profile with respect to the downhole tool location. For example, a particular downhole tool may have a first notional downhole tool performance profile for a first (production string length) portion of a fall portion of a cycle and a second notional downhole tool performance profile for a second (production string length) portion of a fall portion of a cycle, and/or may have a first notional downhole tool performance profile for a first (production string length) portion of a rise portion of a cycle and a second notional downhole tool performance profile for a second (production string length) portion of a rise portion of a cycle. Such different performance profiles are typical for some particular downhole tools, such as bypass plunger that trips open a valve or dislodges a ball at, for example, the well surface to allow a very fast fall velocity. Upon reaching bottom, for example, the valve is closed or the ball mates up with a sleeve, changing the characteristics so that the plunger behaves as a solid-bodied tool for the rise portion. Note that the determination of the particular downhole tool position or state, so as to implement or enable or facilitate adherence to a notional downhole tool velocity profile, may be determined in any of the ways described in the disclosure, to include by way of sensor(s) and calculations.

A conventional well pressure control system 10 of the prior art, such as that depicted in FIG. 1B, does not actively control the speed of the plunger 18, but rather determines a static set point or set value for the system valve pressure value that is estimated to provide an average speed for the plunger equal to the desired or targeted plunger speed $v_{set}$. The plunger average speed or average velocity is $v_{ave}$. As briefly described above, such an average speed during ascent will typically include operating tranches of ineffectively high or low speed that do not support efficiency of the intended fluid lift. The actual plunger speed or velocity is $v_p$. Many controllers, control systems and RTU's have algorithms which make adjustments to timing or triggering of state changes (for example valve closed, valve open, flow after plunger arrival) which are intended to alter the arrival time of a rising plunger, effectively adjusting the average rise velocity. These algorithms, however, fail to provide real-time control of the rise or fall speed of the plunger during those actual portions of the cycle. In contrast, the system of the disclosure, among other things, does provide real-time control of the rise or fall speed of the plunger during actual portions of the cycle. Also, some conventional systems manage or control an average plunger velocity, such as U.S. Pat. No. 5,146,991 to Rogers, incorporated by reference in entirety for all purposes. In contrast, the disclosed system controls the instant plunger velocity during the entirety of the plunger cycle.

Various embodiments of a downhole tool movement control system and method of use will now be described with respect to FIGS. 2A, 2B, 3, and 4.

Figure 2A:
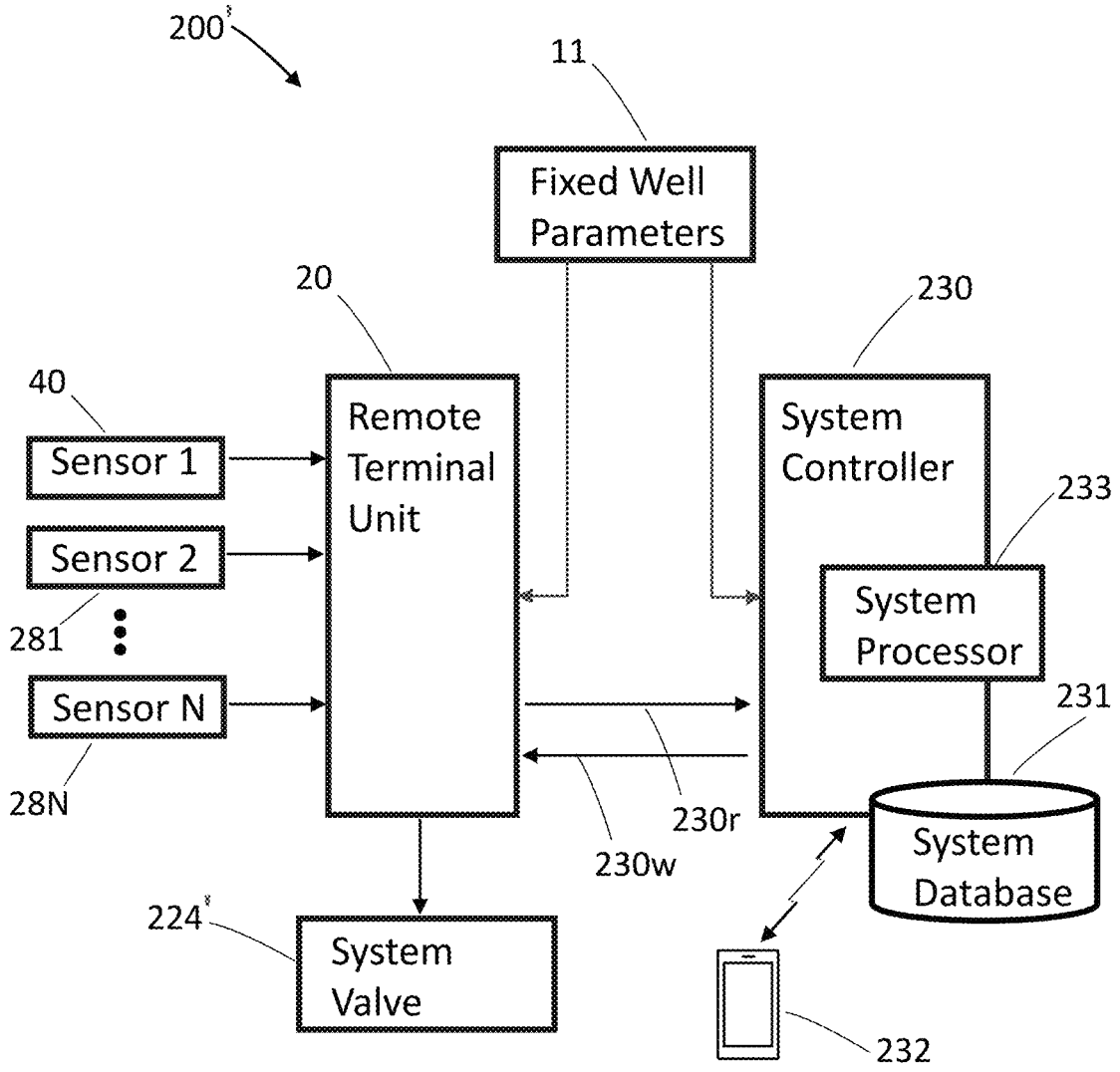
FIG. 2A is a schematic block diagram of the well pressure control system of FIG. 1B integrated with one embodiment of a system controller of a downhole tool movement control system of the disclosure.

FIG. 2A is a schematic block diagram of the well pressure control system of FIG. 1B integrated with one embodiment of a system controller of a downhole tool movement control system of the disclosure.

Figure 2B:
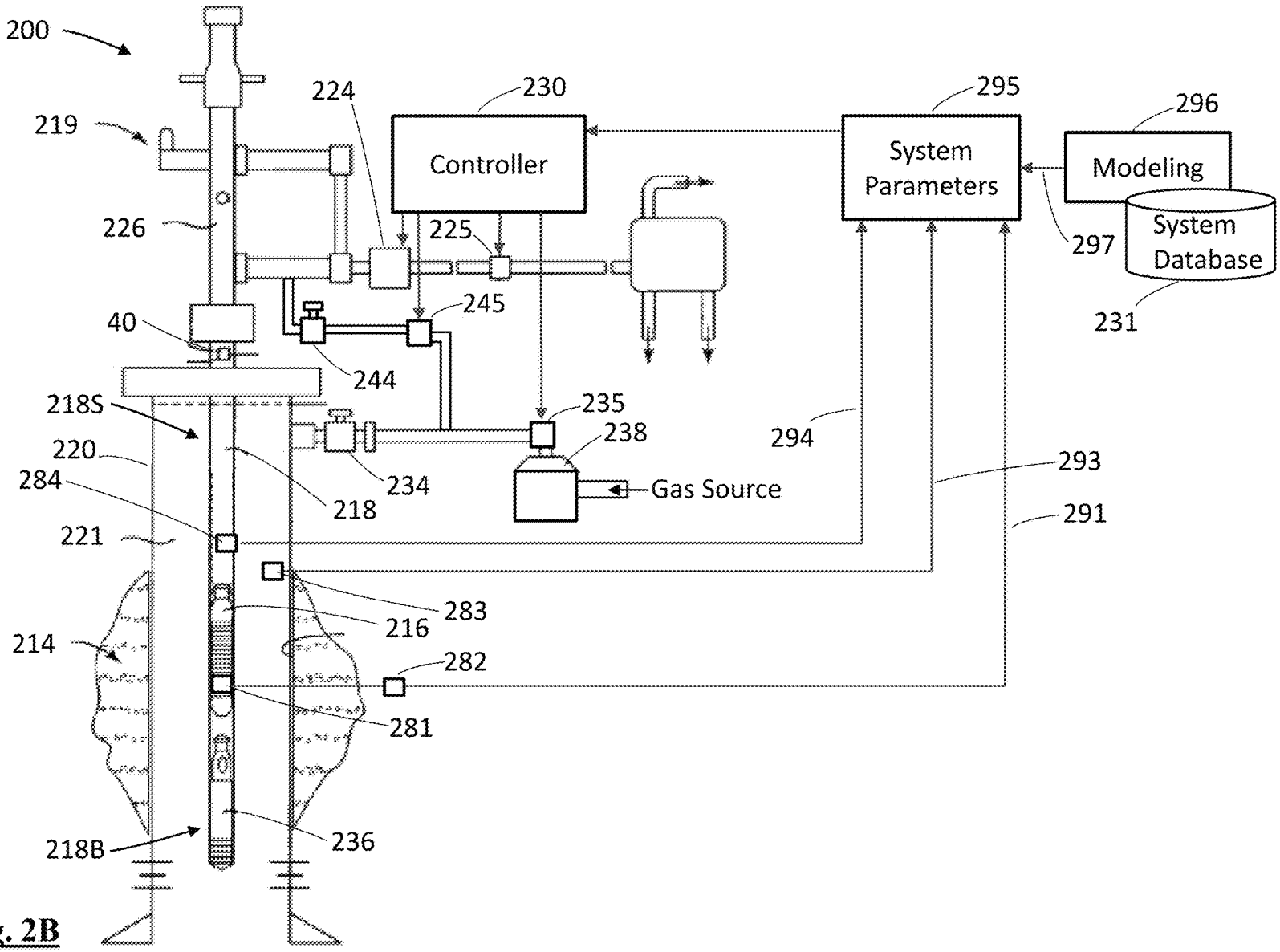
FIG. 2B is a side view representation of one embodiment of a downhole tool movement control system of the disclosure.
Figure 3:
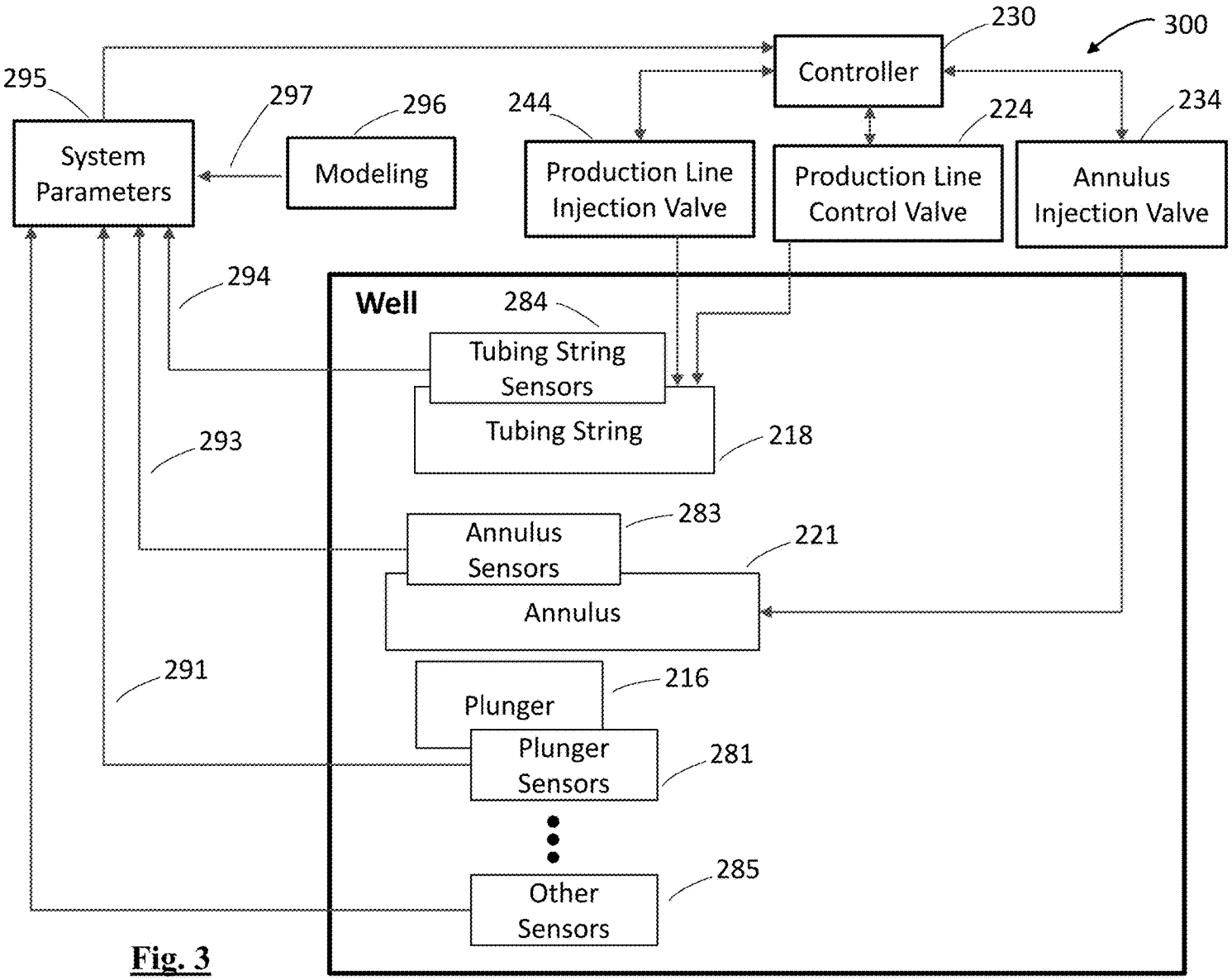
FIG. 3 is a schematic block diagram of the downhole tool movement control system of FIG. 2B.
Figure 4:
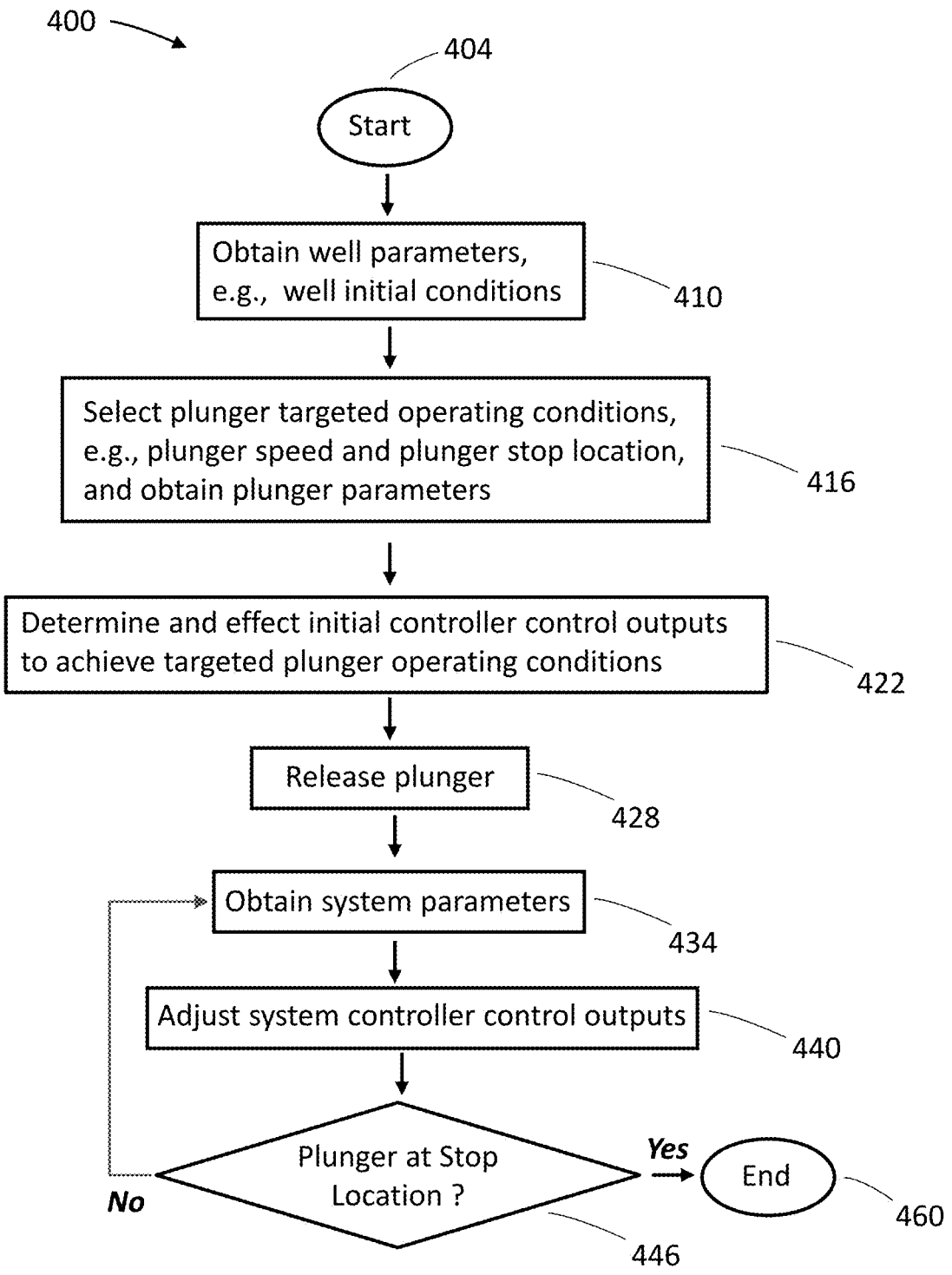
FIG. 4 depicts a flowchart of one embodiment of a method of use of the downhole tool movement control system of FIG. 2B.

FIG. 2B and FIG. 3 are a respective side view representation and a schematic block diagram of one embodiment of downhole tool movement control system. FIG. 4 is a flowchart of one method of use of the downhole tool movement control system of FIGS. 2 and 3.

FIG. 2B depicts a well system in a format similar to that of FIG. 1A with several similar components e.g., the well 214 and plunger 216 of FIG. 2B are akin to the well 14 and plunger 16 of FIG. 1, However, FIG. 2B depicts several features that are unique to a downhole tool movement control system 200, 300 as described below. FIG. 3 presents a schematic block diagram representation of the same downhole tool movement control system 200 of FIG. 2B yet is referenced as downhole tool movement control system 300 due to the alternate representation.

FIG. 4 is a method of use applicable to each of the representations of the downhole tool movement control system 200, 300. Note that some steps of the method 400 may be added, deleted, and/or combined. The steps are notionally followed in increasing numerical sequence, although, in some embodiments, some steps may be omitted, some steps added, and the steps may follow other than increasing numerical order. Any of the steps, functions, and operations discussed herein can be performed continuously and automatically.

With attention to FIG. 2A, the conventional well pressure control system of FIG. 1B is integrated with one embodiment of a system controller 230 of a downhole tool movement control system of the disclosure, such as the downhole tool movement control system 200 of FIG. 2B or the downhole tool movement control system 300 of FIG. 3.

The system controller 230 may comprise a computer processor, the computer processor having machine-executable instructions to operate aspects and/or functions of the downhole tool movement control system.

The system controller 230 interacts or integrates with the control computer or RTU to receive or read data from the RTU (and/or a SCADA or any other conventional processor associated with a typical well, as known to those skilled in the art), depicted as RTU read data 230*r*. The system controller 230 interacts or integrates with the RTU to output or write data to the RTU (and/or a SCADA or any other conventional processor associated with a typical well, as known to those skilled in the art), depicted as RTU write data 230*w*. The RTU read data 230*r* and the RTU write data 230*w* are continuous or near-continuous data feeds, e.g., data provided at a set sampling rate such as 1 Hz, for example. The RTU read data 230*r* may include gas rate, tubing pressure, and/or line pressure. The RTU write data 230*w* may include system valve 224' setpoint (a flow rate, a pressure, e.g.). The system valve 224' setpoint is continuously or near continuously determined by the system controller 230 (as described below, in any of various ways) so as to continuously or near continuously adjust the system valve 224' value or setting. (As the operations of the system controller 230 are typically digital rather than analog, the term continuous means at a consistent selectable rate, such as 1 Hz).

Note that the communications between the system controller 230 and the RTU (and/or SCADA) may use any communication means known to those skilled in the art, to include commercially available standard module bus communications of RTUs. In some embodiments, a single system controller 230 may operate a set of wells, to include interacting or integrating with a set of RTUs and/or a set of SCADAs. In some embodiments, the system controller 230 operates a plunger through one or both of a fall and a rise. In some embodiments, the system controller 230 operates a plunger through a cycle of rise and fall or fall and rise. In some embodiments, the system controller 230 operates a plunger through a series of rise/fall or fall/rise cycles. In some embodiments, the system controller 230 operates a plunger continuously, meaning at all or most times that the plunger is operating in a well.

The system controller 230 also receives fixed well parameters 11, as described above. In one embodiment, the system controller receives additional operational or other data from the fixed well parameters 11 (e.g., temperature at locations of the tubing string, such as at the well head). The system controller may interact with one or both of a system database 231 and a remote user device 232.

The system database 231 may be a physical server and/or a cloud-based system. a physical database operating partially or completely in the cloud. (The phrase "cloud computing" or the word "cloud" refers to computing services performed by shared pools of computer resources, often over the Internet). The system database may perform or assist in any of several functions. For example, the system database 231 may store historical data as to well operation, to include plunger operation with respect to a set of system and/or well parameters, and/or modeling parameters such as those used in modeling element 296 (see below with respect to FIG. 2B). Specifically, the system database 231 may store plunger velocity $v_p$ with respect to well parameters along all or a portion of a rise cycle, a fall cycle, a rise/fall cycle, and/or a fall/rise cycle. The system database 231 may store tables and/or mathematical models of plunger velocities $v_m$ as a function of system and/or well parameters. Note that the system and/or well parameters references may include all or some of the fixed well parameters described above.

The remote user device 232 may be a portable device such as a portable computer, smart phone or tablet computer or may be a fixed device such as a desktop computer. The remote user device 232 comprises a user interface to enable a user to control or operate or monitor the system controller 230 and therefore control or operate or monitor the downhole tool movement control system. (The phrase "user interface" or "UI", and the phrase "graphical user interface" or "GUI", means a computer-based display that allows interaction with a user with aid of images or graphics). The remote user device 232 may comprise an app to facilitate or enable user interaction with the system controller 230. (The word "app" or "application" means a software program that runs as or is hosted by a computer, typically on a portable computer, smart phone or tablet computer and includes a software program that accesses web-based tools, APIs and/or data).

Experimental data comparing the operation of a conventional well pressure control system of FIG. 1B with a conventional well pressure control system integrated with a system controller 230 of a downhole tool movement control system of the disclosure illustrates features and benefits of the downhole tool movement control system.

A plunger was operated in a well and plunger velocities experimentally measured during two rise cycle runs. Plunger velocity as measured by one or more sensors may be referenced as $v_s$.

In a conventional well pressure control system of FIG. 1B, the plunger setpoint velocity ($v_{set}$) was set to 850 fpm. The system valve 24, as set by the RTU 20, was set to fully open (and as is standard, remained in this position throughout the plunger rise cycle). The RTU and/or SCADA reported, for respective run 1 and run 2, a plunger velocity of 990 fpm and 996 fpm. These plunger velocities are presented as average velocities of the plunger (i.e., $v_{ave}$) and are typically based on a very limited set of measurements, such as the time from the assumed departure from the BHA to arrival as sensed at the wellhead. The experimentally measured plunger velocities recorded extremes in actual plunger velocities for run 1 of 857 fpm at open plunger (at BHA, dubbed bottomhole velocity) and 1,364 at plunger arrival (at well head, dubbed surface velocity), and, for run 2, of 892 fpm at open plunger (BHA) and 1,940 fpm at plunger arrival. Such extremes in plunger velocity, as described above, are inefficient at best as to drawing out well fluids, and at worst are dangerous given the potential for well head damage upon receipt of a high velocity plunger at the well head.

In contrast, the well pressure control system of FIG. 2A, with the addition of the system controller 230 and ability to vary the system valve 224' setting (e.g., the valve pressure) as the plunger travels through its rise cycle, results in a much more uniform velocity profile and with much reduced end point velocity values. Specifically, the same conditions as described above were repeated for two runs, except that the plunger setpoint $v_{set}$ was set to 800 fpm. The system valve 224' operated at 80% open for the first 30 seconds of the (rise) run, then employed the calculated flow rates as determined by the system controller 230 to control plunger velocity by way of system valve 224' setting/control for the rest of the plunger rise. The experimentally measured plunger velocities recorded extremes in actual plunger velocities for run 1 of 1,001 fpm at open plunger and 760 fpm at plunger arrival and, for run 2, of 969 fpm at open plunger and 717 fpm at plunger arrival. The RTU and/or SCADA reported, for respective run 1 and run 2, a plunger velocity of 920 fpm and 898 fpm.

Note that the system valve 224' setting may comprise a set of settings, to include valve position, or valve flow rate setting (to achieve a selectable flow rate). The system valve 224' in some embodiments is any device that measures, adjusts, and/or controls flow and/or pressure associated with the system valve 224'. The system valve 224' may be, for example, a pressure differential device, output voltage from a turbine meter, or any other flow measurement devices or methods known to those skilled in the art.

In one embodiment, a user may select a minimum downhole tool velocity of 250 fpm. In one embodiment, a user may select a maximum downhole tool velocity of 2000 fpm.

In another embodiment, the user may select a maximum downhole tool velocity of 1200 fpm. In one embodiment, a user may select an average downhole tool velocity of between 300 and 1500 fpm. In a more preferred embodiment, a user may select an average downhole tool velocity of between 400 and 1200 fpm. In a most preferred embodiment, a user may select an average downhole tool velocity of between 500 and 900 fpm.

With attention to FIGS. 2B and 3, a set of two more detailed schematic block diagrams of the well pressure control system of FIG. 1B integrated with one embodiment of a system controller 230 of a downhole tool movement control system 200, 300 are presented. Note that, among other things, the system valve 224' of FIG. 2A includes valves 224, 244, and 234. Also, system database 231 of FIG. 2A, depicted in FIG. 2B as a portion or sub-component of modeling element 296, may be in direct communication with one or more of controller 230 and system parameters 295 element, and/or may be a portion or sub-component of one or more of controller 230 and system parameters 295 element. Well 214 is located near or adjacent a hydrocarbon deposit. In some embodiments, the well is other than a hydrocarbon deposit, such as a water well or helium well.

The well 214 may be encased in one or more concentric well casings 220. The innermost is typically known as the Production Casing and is in direct contact with the producing zone. Within the well casing 220, a series of tubes or a continuous tube such as coiled tubing, are inserted to form a tubing string 218. The tubing string comprises a surface tubing string portion (or upper tubing string portion or first tubing string portion) 218S disposed at the upper region of the tubing string. The tubing string 218 comprises a bottom tubing string portion (or lower tubing string portion) 218B disposed at the bottom region of the tubing string. The bottom tubing string portion 218B may fully or partially encircle a downhole stop 236.

Note that in some well configurations, fluid (e.g., a gas, liquid, or gas/liquid combination) may enter the tubing string above the end of the tubing string, meaning above the end of the lower string portion 218B, and/or through perforations or punctures above the end of the tubing string to provide cavities or voids that enable gas to enter the tubing string; such configurations are assembled, e.g., during "gas lift" plunger operations. Such injection of fluid may be performed by a fluid injection device that may adjust fluid injection pressure values based on controller signals. The fluid injection device receives fluid from gas compressor 238 (described below). A plunger 216 operates within the tubing string 218. The range of travel of the plunger 216 may vary between the surface tubing string portion 218S and the bottom tubing string portion 218B. Note that the range of travel of the plunger at the lower end of the tubing string often is determined by setting a mechanical "stop" at some intermediate selectable point and/or selectable range. Such a stop also may be placed, for example, between 25% to 80% of the full tubing string to prevent the plunger from descending to a region that will not support the upward return of the plunger.

The cylindrical gap between the well casing 220 and the tubing string 218 is called the annulus 221. Gas or other fluid may exist in the annulus 221. Supplemental gas may be supplied by gas compressor 238 by way of gas injection control valve 234 to the annulus 221 and/or to the tubing string 218. (Note that the supplemental gas from the gas compressor 238 may be supplied in any number of ways, to include as a stand-alone supply and/or by way of the well. For example, the supplemental gas may be supplied by way of a downstream separator which recirculates gas back into the well. Gas lift systems work this way as do combination systems such as Plunger Assisted Gas Lift.) Gas or other fluid may flow between the annulus 221 and the tubing string 218, e.g., entering at or near the bottom tubing string portion 218B. Gas or other fluid may also flow between the annulus 221 and tubing string through one or more gas-lift valves placed at intermediate intervals along tubing string 218. The annulus 221 may comprise one or more annulus sensors 283, such sensors providing, e.g., a measure of gas or other fluid pressure at a particular location within the annulus 221. The one or more annulus sensors 283 provide annulus sensor signals 293 to system parameter element 295.

The tubing string 218 may comprise one or more tubing string sensors 284, such sensors providing, for example, a measure of plunger 216 (vertical or well) location $z_p$ within the tubing string 218 (such as by way of techniques discussed in Bender, for example), plunger 216 measured or sensed speed $v_s$ and/or a measure of tubing string 221 parameters, such as gas or other fluid pressure at a particular location within the tubing string 218. The one or more tubing string sensors 284 provide tubing string sensor signals 294 to system parameter element 295. In one embodiment, tubing string sensors 284 are positioned at one or more connection joints (aka collars) between tubing string portions.

Plunger 216 may include one or more plunger sensors 281, such plunger sensors 281 providing a measure of tubing string 218 parameters, such as gas (or other fluid) pressure or temperature within the tubing string, or measures of plunger kinematics, such as plunger sensed or measured speed $v_s$ and plunger location $z_p$ at a given point, a series of points, a selectable set of points or selectable collection of tranches of points, or over the entire range of plunger travel. In one embodiment, the plunger sensors may include an acoustic sensor, such as an Echometer™, image sensors in various bands such as visible, ultraviolet, and infrared, gyroscopic or proximity sensors, and the like, as known to those skilled in the art.

The plunger sensors 281 may create or enable creation of a speed profile of the plunger, the speed profile based on past operations and/or providing a predictive speed profile of plunger operations. (As may be stored in system database 231 and/or as part of modeling 296 element). Dynamic or real-time (or near real-time) measures may be derived from or sensed by one or more sensors which provide information on tool state (e.g., location and/or velocity), such as one or a plurality of accelerometers, magnetic orientation, other geo-spatial devices, and sensors known to those skilled in the art. The one or more plunger sensors 281 may broadcast or communicate sensed or calculated measurements to a plunger relay 282 which in turn may be connected or in communication with system parameter element 295. The one or more plunger sensors 281 provide plunger sensor signals 291 to system parameter element 295.

The downhole tool movement control system has a set of system parameters 295. The system parameters may include both well parameters and plunger parameters. The set of system parameters may be acquired by any of several means, to include one of more of the above-identified sensors and/or other sensors 285 and through the modeling 296 element. Other sensors 285 may include, for example, a sensor that measures the gas (or other fluid) pressure at the bottom of the well, i.e., the $P_{BH}$, the line pressure at the wellhead 219, and/or line pressures at other locations along the production line.

The system parameter element 295 may also receive system parameters from modeling element 296, which may model various system parameters, such as modeling of fluid pressures and/or fluid velocities.

Any number or variety of modeling techniques may be used, to include deterministic modeling, classic Newtonian modeling, stochastic modeling, multiphase flow modeling, adaptive modeling to include artificial intelligence and machine learning, computational fluid dynamic modeling, and/or modeling techniques known to those skilled in the art. The system (well) parameters may include fluid pressures and/or fluid velocities in the tubing string at one or more locations, fluid properties such as temperature, fluid dynamic conditions, and gas/liquid mixtures such as proportion of gas to liquid. The system (plunger) parameters may include plunger speeds or plunger velocities, and/or plunger modeled or nominal velocity $v_m$ for given well conditions (such as, e.g., average well tubing pressure). Note that one or more of the system parameters may vary with position in the production line, e.g., a plunger speed typically varies with position in the production line and may reach a peak at an intermediate position within the production line or near/adjacent the upper portion of the production line.

In one embodiment, the system (plunger) parameters include $v_m$ as modeled over a portion or entirety of the well, for a given set of well conditions, as provided by a "fall rate calculator" or similar model of plunger kinematics. The fall rate (or rise rate) may be calculated or modeled using any method known to those skilled in the art, to include by way of CFD modeling techniques. In one embodiment, the fall rate and/or rise rate of a given plunger may be determined with input of one or more of the following parameters: tubing Pressure (psig), temperature, tubing Size, SG (specific gravity) of Gas, SG of Liquid, depth of EOT (ft), Average Barrels of Liquid Per Day (bbls), Trips Per Day, plunger type, tubing pressure, input depth of tubing the plunger will travel, number of barrels per day of liquid produced, and number of trips per day the plunger makes.

The modeling may be combined or augmented by measurements, such as measurements provided by the one or more plunger sensors 281 described above. The term "modeling" means a mathematical or logical representation of a system, process, or phenomena, such as a mathematical representation of the kinematics of a plunger operating within a production line given operation conditions. Modeling therefore includes without limitation, any method of calculating or predicting flowing fluid parameters in the well, particularly in the physical proximity of the plunger during movement of the tool, such as multiphase flow correlations known to those skilled in the art, and Machine Learning or Artificial Intelligence-based methods to obtain similar flowing fluid parameters.

The kinematics of the plunger (to include in particular plunger velocity $v_p$ at one or points within the tubing string and/or plunger location $z_p$ at one or points within the tubing string, through techniques to include sensor measurements and/or modeling, are thus monitored and/or predicted for use by the downhole movement control system. The plunger kinematics are controlled by the downhole movement control system so as to operate the plunger at the $v_{set}$. Such plunger kinematics may comprise actual or sensed plunger kinematic profiles and/or predictive plunger kinematic profiles. Other plunger characteristics and/or production line parameters and/or system parameters may also be observed, sensed, and/or predicted, such as production line fluid pressures at one or more positions of the production line, production line fluid temperatures at one or more positions of the production line, and the like. A given set of system parameters, to include the plunger kinematics aka plunger parameters, may be controlled by the downhole movement control system (with controllability achieved through operation or control of the system valve 224' and one or more of valves 224, 244, 234), by any number or set of control techniques using any number of or set of control parameters. For example, the plunger velocity may be controlled through classic feedback control techniques using plunger velocity sensors and plunger internal flow control mechanisms (e.g., mechanisms that control flow through the plunger which will influence the plunger speed) that slows or speeds up the plunger velocity. Other control techniques are possible, such as those mentioned above, e.g., deterministic control, adaptive control, etc. Other control parameters, alone or in combination are also possible, to include control, monitoring, sensing, and/or modeling of production line parameters, to include, e.g., fluid temperature, fluid pressure, etc. at one or more positions in the production line.

In one embodiment, one or more of the set of system parameters 295 may be obtained through one or more sensors fitted to the downhole tool (as described above), and/or as disposed on or near the production line or on or near the wellhead, as described by, for example, in Bender.

The system (well) parameters 295 may include any of several characteristics of well operations, such as, for example: makeup of gas and liquids (stated another way, the relative proportion of gas and liquid), well bottom temperature, fluid phases or mixtures thereof, fluid characteristics such as density, viscosity, pressure, speed/velocity, etc.; physical characteristics of the tubing string e.g. diameter, tubing material, tubing condition (new, corrosion, erosion), depth of tubing placement, inclination, and tortuosity; surface conditions e.g. wellhead temperature, piping and valve arrangements, gathering or receiving system pressures and temperatures, production line pressure at or near the wellhead (e.g. production gas pressure, production liquid pressure, production gas/liquid pressure) which may be measured by electronic flow meters (EFM) 225, 235, 245 (see FIG. 2B); downhole conditions such as gas pressure within the tubing string at one or more locations or depths within the tubing string or within the annulus, gas velocity or gas speed within the tubing string at one or more locations or depths within the tubing string or within the annulus; and plunger parameters such as plunger speed, plunger location, and ideal or optimal plunger speed given tubing string or other well conditions. Any set or all of the system parameters may vary with location in the production string. In one embodiment, the production string is a casing string. In one embodiment, the production string is a tubing string. In one embodiment, the production string is a tubing string, the tubing string positioned within a casing string.

The downhole tool, such as plunger 281, is configured to travel freely within the tubing string 218 between a first tubing string portion (e.g., the uppermost tubing string as connected with the wellhead, i.e., tubing string portion 218S) and a second tubing string portion (e.g. the lowermost tubing string as coupled to the bottom of the well and in receipt of fluid from the hydrocarbon deposit, i.e. tubing string portion bottom 218B). This is defined as the "fall" portion of the cycle. This is followed by the "rise" portion of the cycle whereby the downhole tool is driven by fluid pressure and velocity from the bottom string portion 218B and the upper string portion 218S or wellhead. The "rise"

portion of the cycle comprises the actual pumping action of a plunger in plunger lift and is the primary action we seek to control.

The downhole tool, e.g., a plunger, is typically engineered to optimally operate during the "rise" portion of the cycle within a speed range and/or at a given speed value. Such speed may be deemed a target speed range or a target speed value. In one embodiment, the plunger optimal speed is between 600-900 feet per minute (fpm). Typical Plunger optimal speeds are known to those skilled in the art as a function of plunger type and plunger operating (e.g., well) conditions. Plunger optimal speeds are also often determined through trial and error, or by empirical methods as may be observed by comparing production results with various speed settings. An operator or system user typically seeks a desired set point velocity for the plunger ($v_{set}$) of a range of velocity for the plunger e.g., within a set percentage of speed range of the $v_{set}$. Such set point data may be provided by a user via an app and/or via user interface 232 of FIG. 2A. The operator or system user may also seek operation of the plunger at a selectable velocity of speed profile (see FIGS. 5B-D and associated description below).

A production line control valve 224 is located at the well head 214 area and may be adjusted to influence flowing volumetric rates and pressure values within the production line such as tubing string 218. (In one embodiment, the production line control valve 224 may operate or function in the manner described above with respect to system valve 224' of FIG. 2B). The production line control valve 224 may be in communication with a production line electronic flow meter (EFM) 225. The production line gas injection EFM 225 may monitor and/or measure line pressure at the well head 219 and is in communication with the system controller 230. The production line control valve 224 is in communication with system controller 230. In some embodiments, the relative location of the production line gas injection EFM 225 and the production line control valve 224 are exchanged, meaning that one may be either upstream or downstream of the other. System controller 230 may be referred to as "controller."

One or more supplemental gas volume valves may be fitted to the system 200, 300. (In one embodiment, one or both of the supplemental gas volume valves 234, 244 may operate or function in the manner described above with respect to system valve 224' of FIG. 2B). In the embodiments of FIGS. 2 and 3, two supplemental gas volume valves are fitted to the system: a production line injection valve 244 (which injects gas into the production line) and an annulus injection valve 234 (which injects gas into the annulus). Collectively, the production line injection valve 244 and the annulus injection valve 234 are referred to as "supplemental gas volume valves." Each of the supplemental gas volume values receive supplemental gas from gas compressor 238, the gas compressor 238 receiving gas from a gas source.

Gas provided from gas compressor 238 is provided to the production line by way of production line injection valve 244, the production line injection valve 244 controlled by the system controller 230. The system controller 230 may control the gas provided to production line injection valve 244 with aid of and/or with measurements provided by the production line gas injection electronic flow meter (EFM) 245.

Gas provided from gas compressor 238 is provided to the annulus by way of annulus injection valve 234, the annulus injection valve 234 controlled by the system controller 230. The system controller 230 may control the gas provided to annulus injection valve 234 with aid of and/or with measurements provided by the annulus gas injection electronic flow meter (EFM) 235.

The annulus injection valve 234 may be in communication with annulus gas injection electronic flow meter (EFM) 235, which in turn is in communication with controller 230. In one embodiment, the annulus injection valve 234 is in direct communication with controller 230. In some embodiments, the relative location of the annulus gas injection electronic flow meter (EFM) 235 and the annulus injection valve 234 are exchanged, meaning that one may be either upstream or downstream of the other.

In some embodiments, the annulus gas injection electronic flow meter (EFM) 235 is located downstream of the split of the gas injection line feeding the production line gas injection line which comprises electronic flow meter (EFM) 245 (see FIG. 2). In some embodiments, each of the production line gas injection line and the annulus gas injection line are separate lines which directly connect to the gas compressor 238. In some embodiments, the production gas injection line uses gas from the annulus gas injection line independently of the compressor.

As discussed above, the supplemental gas volume may be supplied to the annulus 221 of a well to the bottom or to some intermediate point of the well, or to multiple intermediate points of the well between the upper portion 218S and the lower point 218B (to include, for example, injection into the production line at or near the upper portion of the production line) wherein the gas enters the tubing string 218 at the production string at that point 218B, thereby increasing gas pressure and gas flow into the production string at that point of the well. Such supplemental gas may be employed to control the plunger 281 movement within the tubing string 218.

The production line control valve 224 and/or the supplemental gas volume control valves 234, 244 may adjust in any of several ways, to include simple fully on or fully off aka on/off configuration, a selectable maximum value and a selectable minimum value, and variable settings within a percentage on fully open (100%) to fully closed (0%). Other valve configurations known to those skilled in the art are possible.

The system controller 230 operates to control the production line control valve 224 and/or the supplemental gas volume control valves 234, 244 between valve settings in any of several ways, to include on/off aka full open/full close control, proportional control, PID aka proportional-integral-derivative control, adaptive control, artificial intelligence or machine learning, adaptive control, stochastic control, and any control schemes known to those skilled in the art (to include control schemes identified above regarding controllers and/or control systems).

The system controller processes a received set of system parameters 295, such as tubing string parameters and other such parameters as identified above (to include plunger parameters), and communicates controller signals associated with the set of system parameters to the production line control valve 224, the supplemental gas volume control valves 234, 244, and/or the electronic flow meters (EFM) 225, 235, 245, wherein the production line control valve 224 and/or the supplemental gas volume control valves 234, 244 adjust conditions within the tubing string 218 to effect and control the movement of the plunger 216, namely the plunger velocity.

In one embodiment, the system controller transmits a particular downhole tool position (such as the downhole tool positioned at or near the bottom of the production casing), or when the downhole tool realizes a particular state (such as when the downhole tool reaches a zero velocity turning point state during the end of a fall portion of a cycle just prior to beginning a rise portion of a cycle). Such a transmittal from the system controller may assist the overall downhole tool movement control system in operations, such as preparing and/or enabling the system control to initiate a rise portion of a cycle at the termination of a fall portion of a cycle. Note that the determination of the particular downhole tool position or state may be determined in any of the ways described in the disclosure, to include by way of sensor(s) and/or calculations.

In one embodiment, the system controller 230 operates or controls movement of the plunger 216 (such as the $v_p$) using a controller schedule created through calibration of plunger operations. The kinematics of a plunger are first documented or recorded against well conditions throughout a given plunger cycle, meaning throughout a particular fall and rise cycle of a plunger, representing the notional or modeled plunger kinematics, such as notional or modeled $v_m$ for a given set of well and/or plunger parameters. These data may be obtained through any of several means, to include, e.g., an instrumented plunger, modeling, a series of sensors on the tubing or in the annulus, or through continuous sensing in the wellbore (e.g., fiber optic cable, tech line, e-line). These plunger predicted or notional or modeled kinematics (location and velocity) data are transmitted to a processor (such as processor 233 of controller 230) which correlates or calibrates the data with respect to actual well data (such as well flow data, injection valve rates, etc.) for that particular plunger cycle. The data may be transmitted in real-time or captured and transmitted periodically (e.g., the plunger may only transmit data at the apex of a rise). The processor 233 may be a stand-alone processor and/or the system controller 230, and/or may be stored or processed as part of or in coordination with the system parameters 295. The resulting correlated or calibrated set of data form a controller schedule that maps or relates plunger kinematics as a function of well data or well conditions, thereby enabling the system controller to control plunger movement. The downhole tool movement control system thus "learns" how the plunger responds to variations in controller outputs and creates an operating control map. Note that once the controller map or controller schedule is created, the described instrumentation may no longer be required. For example, if the data were obtained through an instrumented plunger, the instrumented plunger could then be replaced with a non-instrumented plunger. With use of the control map or controller schedule, the downhole tool movement control system may operate variable-rate control of a plunger without need of sensor inputs other than flowrate and time from a point in the cycle.

The control of the plunger velocity $v_p$ to a desired set velocity $v_{set}$ by way of the system controller 230 may be described with attention to the monitoring or determination of the actual plunger velocity $v_p$. As described above, the system controller adjusts one or more valves 224, 234, 244 so as to adjust one or more well parameters to effect or control the kinematics of the plunger, such as plunger velocity $v_p$ to a desired set velocity $v_{set}$.

The "actual" plunger velocity $v_p$ (or more precisely, the plunger velocity input used by the system controller 230 to effect control of the plunger velocity) may be determined in any of several ways, to include empirical tables (aka look-up tables), tabled correction factors, instrumentation or sensors, and various modeling techniques.

A set of empirical tables may be constructed, as may be stored in the system database 231, of plunger velocities $v_p$ at a set of tubing locations $z_p$ for a given set of plunger parameters and well parameters. For example, a table may be constructed that presents a set of paired plunger velocities at tubing locations (e.g., at fifty such locations) for a given set of plunger parameters (e.g., a specific plunger type) and well parameters (e.g., tubing pressure, line pressure, etc., as described above). As such, once it is known (by, e.g., conventional means of identifying plunger at end points—well bottom and well head) the start and stop plunger state, the plunger velocity may be used as an input for control of the plunger by the system controller 230 (via one or more system valves). The look-up tables thus provide a control input to the system controller 230 to effect control of the plunger 216.

A set of tabled correction factors $K_v$ may also be used to control the plunger velocity. In this approach, the actual plunger velocity $v_p$ is determined by applying a particular correction factor $K_v$ for a given set of plunger parameters and/or well parameters as applied to a notionally determined plunger velocity $v_m$ determined by any of several means. For example, the notionally determined plunger velocity $v_m$ may be determined through the fall rate calculator as described above, with Kv established as a function of the parameters used by the fall rate calculator as described above. In this manner, the tabled correction factor adjusts the notional plunger velocity as described by: $v_p=(K_v)v_m$. Correction factors may also include factors to account for changes in liquid load as determined by pressure measurements, or by other sensors or measurement devices.

A set of tables or maps or other optimization representations may also be employed, such tables or maps generated through, in one embodiment, Machine Learning or Artificial Intelligence-based approaches that model plunger movement and direct changes to the operating algorithms of controller 230. In other embodiments. Such tables or maps are generated through historical data analysis of well operations, or other methods known to those skilled in the art.

A set of measured or sensed values of the location and velocity of the plunger while operating in the tubing string may also be used to control the plunger velocity to the desired set velocity. This is a classic control system approach, wherein sensor input values of the item to be controlled (the plunger) are directly measured and an output is determined (valve setting) so as to effect control. Such an approach has been described above. Note that in this approach, the plunger velocity $v_p$ used or employed as a control input to the system controller 230 is indeed an actual plunger velocity, to the degree a measured plunger velocity is an actual velocity without sensor measurement error. In one embodiment, considered an indirect control approach, sensor input values other than the item to be controlled are measured and used to effect control. For example, one or more well parameters may be measured so as to determine controller outputs to effect or control plunger velocity.

Various modeling techniques may also be used to determine the plunger velocity $v_p$ given well parameters and/or plunger parameters. In addition to the modeling techniques discussed above, the notional plunger velocity $v_m$ may be adjusted to account for or reflect one or more well parameters and/or plunger parameters, as described above. Such velocity adjustment factors may generically be referred to as $v_f$. For example, $v_f$ may include one or more of downhole conditions such as gas pressure within the tubing string at one or more locations or depths within the tubing string or within the annulus, gas velocity or gas speed within the tubing string at one or more locations or depths within the tubing string or within the annulus. In this manner, the actual plunger velocity, as used by the system controller 230 to control the plunger kinematics such as plunger velocity to a desired or set plunger velocity at various tubing locations $z_p$ or plunger depths, may be described by: $v_p=v_f-v_m$.

The above techniques for plunger control by the system controller may be combined, e.g., the value of $v_m$ as described in the immediately above velocity adjustment factor technique may be obtained or supplemented by use of, e.g., the described empirical table or Machine Learning or Artificial Intelligence techniques.

Note that in any or all of the above techniques, the downhole movement control system may adapt or learn or adjust or calibrate control values (e.g., to the system valve) based on actual performance or kinematics of the plunger. For example, an end-to-end measurement of rise time (from BHA to wellhead) may determine that the plunger's actual rise time is several seconds faster than predicted based on one of the above control techniques. The system controller may then adjust one or more parameters of its control technique to adapt to the disparity in rise time. For example, if the tabled correction factor $K_v$ technique was employed, the value $K_v$ may be slightly adjusted. Such an auto-correlation capability may be required when a different plunger is used than that identified by a user, or when, with time, a plunger changes its performance (e.g., the plunger with times develops a smoother or worn exterior surface, resulting in slightly reduced hydrodynamic drag and thus a slightly slower rise time.)

The system controller 230 may calculate the plunger velocity $v_p$ at any number of frequencies, to include a fixed frequency (e.g., 1 Hz, at least every one second) or a dynamic frequency (e.g., 10 Hz within a set distance from end points and 1 Hz elsewhere). The result of the downhole tool movement control system is control of the movement, e.g., the speed or velocity, of the downhole tool to within a target speed range and/or the target speed value of the downhole tool. The target speed range of the downhole tool may be selectable by the user. The control of speed of the plunger is performed by variation, by way of the system controller, of conditions within the tubing string, such as one or more of the above-identified system parameters and/or the system valve. Most commonly, the production string flowing conditions are controlled by varying the flow rate through valve 224, valve 234, and/or valve 244, if applicable.

In one embodiment, the downhole tool movement control system is used in a well that continues to flow i.e., produce such that the production line control valve 224 never completely shuts and both ascending and descending velocity of the plunger is controlled. In such a well scenario, the well continues to maintain a rising flow up through the well, yet the (bypass) plunger is regulated or controlled, by the downhole tool movement control system, to fall or descend against the flow of the well at a desired or selected speed until the plunger reaches a stop or turnaround point, after which the downhole tool movement control system switches to a "rise mode" and controls the rise velocity of the plunger. The controllability of the plunger is provided to the downhole tool movement control system by controlling the well flow rate (by, e.g., any of the above-described techniques, to include one or more injection valves, etc.). Note that in this embodiment, when the plunger is descending against the flow of the well, the plunger may be considered to have a negative velocity relative to the flow of the well, and to have a positive velocity relative to the flow of the well when the plunger is ascending with the flow of the well. FIG. 4 provides a method of use 400 of the downhole tool movement control system 200, 300. The method starts at step 404 and ends at step 460. Any set of the steps of the method 400 may be automated completely or partially.

After starting at step 404, the method 400 proceeds to step 410. At step 410, well parameters aka well state conditions are obtained. Such state conditions would include well configuration (e.g., casing diameter, tubing diameter, tubing depth, gas to liquid ratios, fluid properties, line pressure, pressure at bottom of the hole i.e., $P_{BH}$, etc.), availability of supplemental gas (see Scenario Two below), maximum allowable plunger speed within tubing string (e.g., to include at well head, at well bottom, and during transition between well head and well bottom), and acceptable range of plunger speed. After completion of step 410, the method 400 proceeds to step 416.

At step 416, the operator selects plunger operating conditions, e.g., target plunger speed, and target plunger stop or turn around location (see Scenario One below). The target plunger stops or turn around location may more generally be referred to as a physical downhole tool tubing string stop point or a desired turnaround point above a physical stop and selectable by a user. In one embodiment of the method 400, the stop location is at or near the BHA. (In one scenario, the stop location may be an unintended, undesirable, and/or unexpected stop location, as described in Scenario Four below). After completing step 416, the method proceeds to step 422.

At step 422, the controller determines control outputs to achieve the targeted plunger operating conditions, e.g., to achieve a targeted plunger speed. The controller sets or determines the control outputs (the control outputs used to control the tubing line pressure valve 224 and/or the supplemental gas volume valves 234, 244) to control the plunger movement in the tubing string. The control outputs are influenced or established by one or more of the system parameters 295 and any of the techniques described above regarding determination of the plunger actual velocity $v_p$. For example, the control outputs may be influenced or established by use of or differences between one or more system parameters, the system parameters described above. In another example, plunger kinematics may be controlled by control or management of one or more of the identified system parameters, to include characteristics of the production line, such as production line fluid velocity, etc. After completing step 422, the method proceeds to step 428, wherein the plunger is released into the production line (here, a tubing string), e.g., the plunger may be released from the well head 219 to descend toward the bottom of the well, or the plunger may be released to ascend the well from an interim location or any location within the tubing string (see Scenario Two). After completing step 428, the method proceeds to step 434.

At step 434, as the plunger is moving within the tubing string (such as in a rise or in a fall), the system receives or obtains or determines one or more system parameters and/or plunger kinematic properties, such as $v_p$ and/or $z_p$ as described above. More specifically, the controller 230 receives one or more updated or additional system parameters. For example, the controller may receive one or more measurements of speed of the plunger 216 from the plunger sensor 281. After completing step 434, the method proceeds to step 440.

At step 440, as a result of receiving updated or new system parameters and/or plunger kinematic properties, the controller determines adjusted control outputs to provide to the production line control valve 224 and/or the supplemental gas volume valves 234, 244. The controller 230 control signals result in adjustments to the production line control valve 224 settings and/or the supplemental gas volume valves 234, 244 settings, resulting in control of the plunger movement in the tubing string. After completing step 440, the method proceeds to step 446.

At step 446 a query is made to determine if the plunger is located at the desired plunger stop location (see Scenario One); if the result is NO, the method 400 proceeds to step 434 and continues to loop until the result is YES, then the method 400 proceeds to step 460 and the method 400 ends.

Figure 5A:
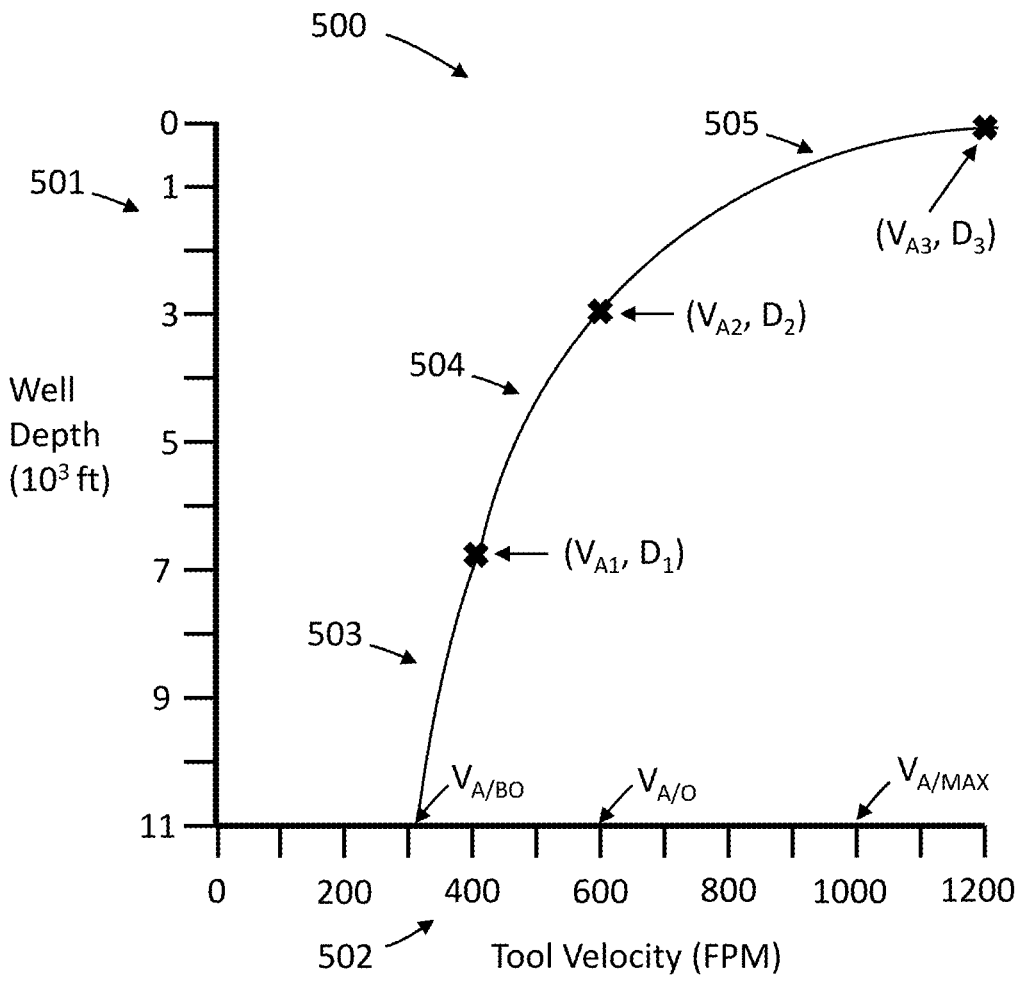
FIG. 5A depicts a representative conventional velocity profile of a downhole tool of the prior art.
Figure 5B:
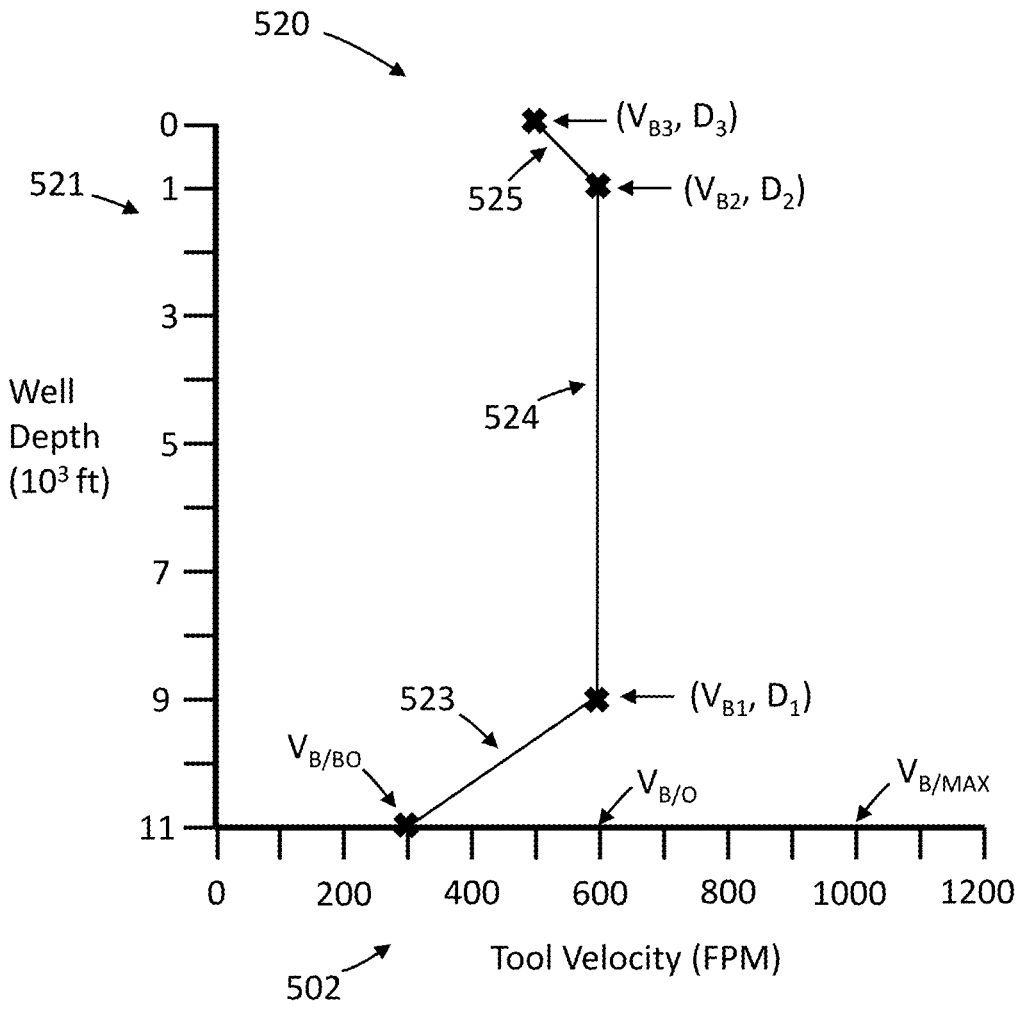
FIG. 5B depicts a first velocity profile schedule used as an input to a downhole tool movement control system of the disclosure.
Figure 5C:
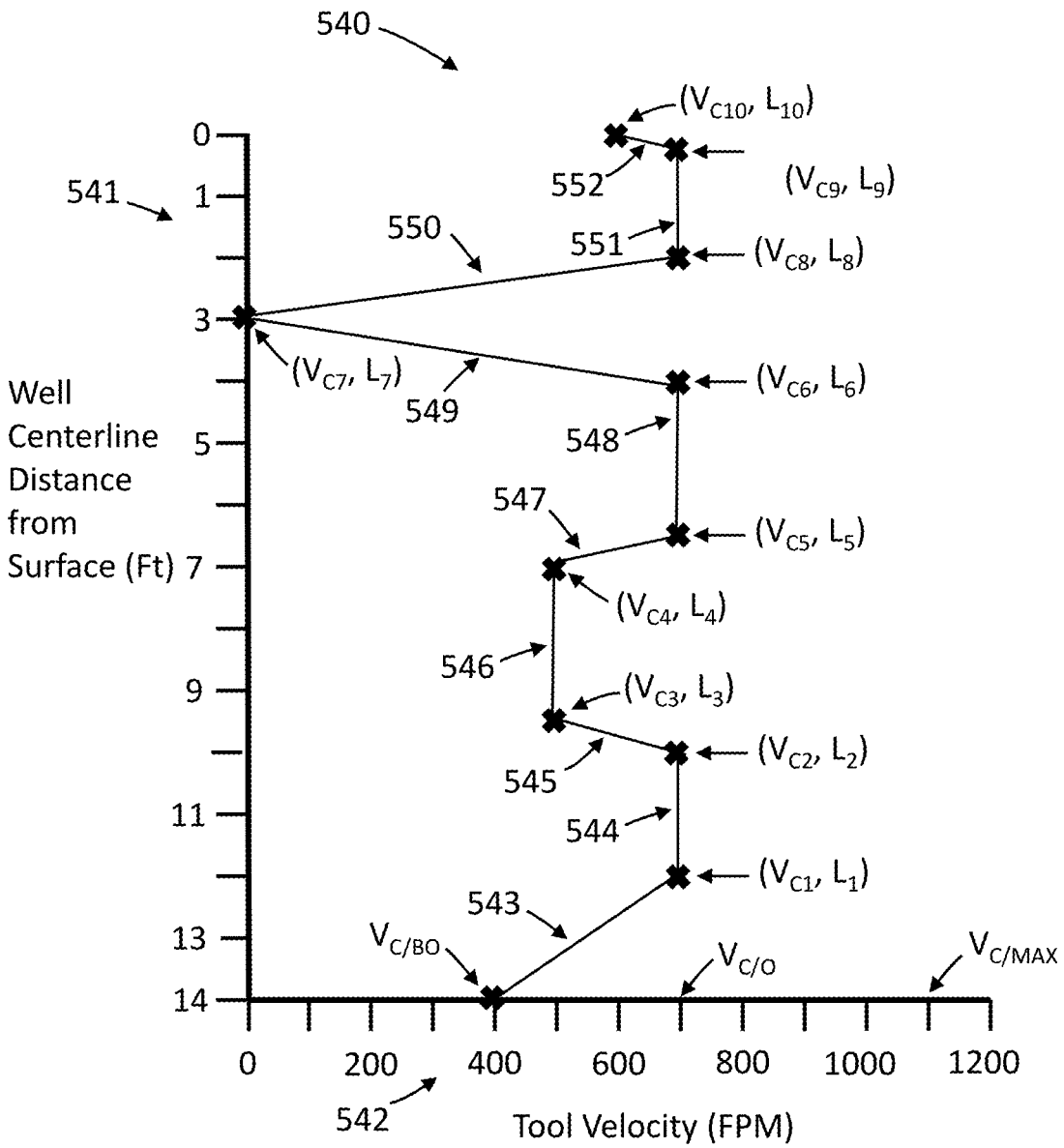
FIG. 5C depicts a second velocity profile schedule used as an input to a downhole tool movement control system of the disclosure.
Figure 5D:
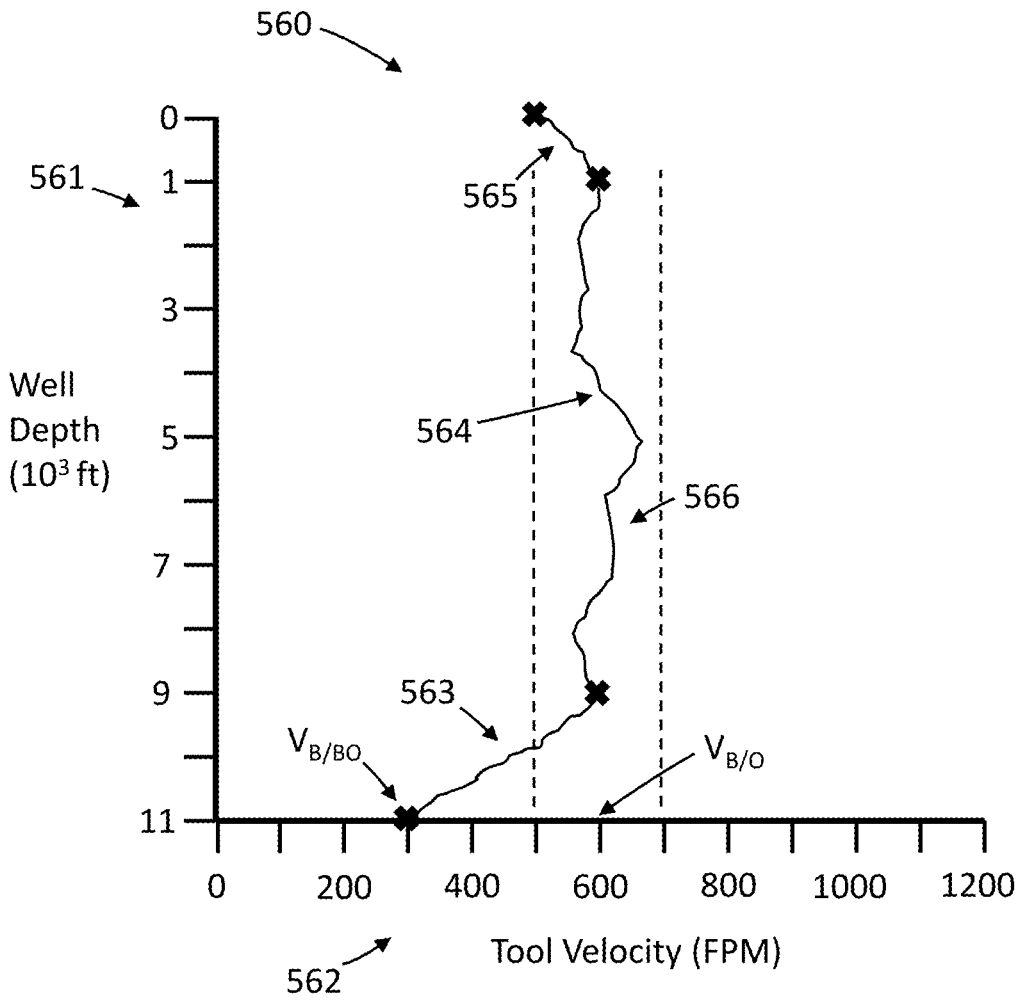
FIG. 5D depicts a representative actual velocity profile as achieved by a downhole tool movement control system of the disclosure operating to the first velocity profile schedule of FIG. 5B.

FIGS. 5B-D describe operations of the downhole tool movement control system of the disclosure against a selectable downhole tool velocity profile schedule. As briefly mentioned above, a user may provide a downhole tool velocity schedule (a desired set of downhole tool velocities with respect to location of the downhole tool in a tubing string). The downhole tubing string may be described or referenced as well depth in a vertical well, or by well measured depth (MD) in a horizontal or vertical/horizontal well (common in unconventional wells, e.g.).

FIG. 5A depicts a representative conventional velocity profile of a downhole tool of the prior art, the tool operating in a rise or ascent from a well bottom location to a surface location. As described above, conventional operations at best minimally control a downhole tool (such as a plunger) during the plunger's movement within a tubing string. The result is a plunger that commonly exceeds maximum plunger velocity, frequently reaching an unsafe velocity well above the plunger maximum velocity when reaching the surface after a rise cycle. Such is described in FIG. 5A.

FIG. 5A describes a conventional plunger rise operation 500 of the prior art. Plunger (aka tool or downhole tool) velocity is presented on the x-axis 502 in feet per minute (fpm) for a given y-axis 501 well depth in thousands of feet (ft). The tool begins a rise cycle at the bottom of the well depth (here, at 11,000 ft), and begins to move once a plunger break out velocity $V_{A/BO}$ is reached (here, 350 fpm). The plunger has an optimal velocity (a speed at which, for a given set of well conditions, an optimal effectiveness of plunger lift is obtained) of $V_{A/O}$ (here, 600 fpm). The plunger then rises, through portion rise 503, up the tubing string to reach ($V_{A1}$, $D_1$)=(400, 7000), then continues through rise 504 to reach ($V_{A2}$, $D_2$)=(600, 3000), and finally executes rise 505 to reach the surface of ($V_{A3}$, $D_3$)=1200, 0). Note that the final speed of 1200 fpm, and throughout much of the rise 505, the plunger is operating above its desired maximum speed $V_{A/MAX}$ of 1000 fpm.

The downhole tool movement control system, such as described above, may operate to a selectable downhole tool velocity schedule. Stated another way, the downhole tool movement control system may control a plunger or other downhole tool to a specified velocity at a given tubing location. Such a schedule may be established for a rise portion, a descend aka fall portion, or both a rise/fall and fall/rise cycle. FIGS. 5B and 5C describe representative selectable velocity schedules for plunger operations controlled by the downhole tool movement control system. Other schedules are possible, to include non-linear schedules. Velocity schedules may be combined and may vary with each cycle.

FIG. 5B depicts a first velocity profile (rise) schedule 520 used as an input to a downhole tool movement control system of the disclosure. Plunger (aka tool or downhole tool) velocity is presented on the x-axis 522 in feet per minute (fpm) for a given y-axis 521 well depth in thousands of feet (ft). The rise schedule 520 comprises three portions: a first portion 523, a second portion 524, and a third portion 525, as the plunger travels from the deepest well depth position (here, 11,000 ft well depth) to the surface (here, at 0 ft well depth). The plunger has a break-out velocity of $V_{B/BO}$ of 350 fpm, and optimal velocity $V_{B/O}$ of 600 fpm, and a maximum desired velocity of $V_{B/MAX}$ of 1,000 fpm. The velocity profile schedule 520 depicts a schedule for a vertical well.

The velocity profile 520 has the plunger rising from (300, 11,000) along first portion 523 to position ($V_{B1}$, $D_1$)=(600, 9,000). Note that $V_{B1}$ of 600 fpm is the plunger optimal velocity. The plunger velocity profile then enters the second portion 524 in which the plunger maintains a steady 600 fps from ($V_{B1}$, $D_1$)=(600, 9,000) to ($V_{B2}$, $D_2$)=(600, 1,000). Lastly, as the plunger continues its rise, the plunger enters the third portion 525 from ($V_{B2}$, $D_2$)=(600, 1,000) to ($V_{B3}$, $D_3$)=(550, 0). Note that the plunger thus arrives at the well head or well surface at a velocity of 550 fpm. Such reduction in velocity in the upper portion is commonly seen when liquids above the plunger pass through the wellhead. Among other things, the plunger, if operating at the first velocity profile (rise) schedule 520, operates for a majority of its rise cycle at the plunger's optimal (steady state) velocity (here, of 600 fpm).

Note that plunger steady state velocity may be defined in any of several ways. Most generally, the plunger steady state is the plunger velocity after the plunger has departed from a well bottom (that is, has moved out from a break-out speed) and moved a specified distance from the well bottom position. With reference to FIG. 5A, a steady state speed is ill-defined if not impossible to define, as the plunger continuously increases in speed during its rise cycle without control of the driving fluid flow due to expansion of the gas phase as pressure decreases as it rises in the well. In one embodiment, the steady state speed is the plunger speed when the plunger is moving over some defined interval but excluding start/stop conditions, e.g., the speed after the plunger breaks out from a resting well bottom position and accelerates to a given speed.

FIG. 5C depicts a second velocity profile schedule 540 used as an input to a downhole tool movement control system of the disclosure. The velocity profile schedule 540 depicts a schedule for a well with tubing sections other than vertical, such as a well with a horizontal portion. Plunger (aka tool or downhole tool) velocity is presented on the x-axis 542 in feet per minute (fpm) for a given y-axis 541 well measured depth from surface in thousands of feet (ft).

The rise schedule 540 comprises ten portions of consecutive integer numbers 543-552. Generally, rise schedule 540 operates for three portions (544, 548, and 551) at a velocity of 700 fpm, the plunger's optimal velocity $V_{C/O}$ and a portion 546 at a velocity of 500 fpm. Remaining portions 543, 545, 547, 549, 550, and 552 are transitional portions between two endpoint velocity values. Note that at position ($V_{C7}$, $L_7$)=(0, 3,000) the plunger comes to a stop of 0 fpm. The plunger of FIG. 5C has a maximum desired velocity of $V_{C/MAX}$ of 1,100 fpm. Note that the plunger arrives at the well head or well surface at a velocity of 600 fpm.

FIG. 5D depicts a representative actual velocity profile 560 as achieved by a downhole tool movement control system of the disclosure operating to the first velocity profile schedule 500 of FIG. 5B. Like FIG. 5B, plunger (aka tool or downhole tool) velocity is presented on the x-axis 562 in feet per minute (fpm) for a given y-axis 561 well depth in thousands of feet (ft). The tool begins a rise cycle at the bottom of the well depth (here, at 11,000 ft), and begins to move once a plunger break out velocity $V_{A/BO}$ is reached (here, 350 fpm). The plunger has an optimal velocity (a speed at which, for a given set of well conditions, an optimal effectiveness of plunger lift is obtained) of $V_{A/O}$ (here, 600 fpm). The plunger then rises, first through portion rise 563, then continues through rise 564, and finally executes rise 565 to reach the surface. During rise 564 portion the actual tool velocity maintains a velocity within a selectable velocity band 566. A velocity band is appropriate to accommodate plunger velocity variations from the optimal velocity due to possible changes in gas and liquid inflows from the reservoir, allowance for response time of measurement systems and allowances for response times and characteristics of control devices.

A series of four example operating scenarios is presented below. These scenarios in no way limit the uses or embodiments of the well production system and/or the methods of use of the well production system.

Operating Scenario One

The downhole tool movement control system may be configured with a primary objective to control the rise velocity of the downhole tool, such as primarily a plunger used to pump fluids from a wellbore. In its most basic use, the plunger is allowed to fall from surface, whether in static, non-flowing, shut-in conditions or against some flow that the tool is designed to overcome (e.g., bypass plungers). Once the tool has reached the lowest point in the well from which the pumping action is to take place, one or more valves at the surface are opened to provide sufficient upward flow of gas and liquid, such that the mixture drives the plunger upwards toward the surface. The flow rates and pressures of the mixture are impacted by the expansion of gas volume as the plunger travels from the higher-pressure lower portions of the well to the lower-pressure upper portions. The downhole tool movement control system regulates the flow through the one or more surface valves to maintain a desired speed/velocity of the rising plunger, either to a predetermined setpoint or within a specified setpoint range, compensating for changes in the forces which drive the plunger over the distance of its intended travel and with particular attention to control of the actual plunger velocity $v_p$. The result is a consistency in plunger travel speed over the rise portion of the cycle, improving pumping efficiency, reducing tool wear and improving safety conditions at surface.

Operating Scenario Two

The downhole tool movement control system may operate to switch from plunger fall to plunger rise at any point in the cycle. In certain cases, an operator may want to send the plunger only to a certain selectable depth, the selectable depth not necessarily the bottom or to a physical stop or spring assembly, and then reverse direction and bring the plunger back to surface. Such a capability would allow one to pump or "swab" (a common term for removing fluid from higher in the tubing string) based on the system parameters. The system parameters can determine, via the controller, the point at which the plunger will run in wells that have difficulty running plungers due to high liquid content. In such cases, the gas velocity deep in the well is not sufficient to drive the plunger, but higher up in the well the gas expansion and breakout changes the gas to liquid ratio (gas as actual volume, not standard volume) sufficient to provide favorable conditions. In typical current practice, an operator may guess or calculate the point this occurs in a well under flowing conditions and choose to set a fixed stop (spring assembly) at that point and run the plunger from there. One advantage of the disclosed downhole tool movement control system in operations to a selectable depth is the ability to select (and achieve) operating turns of the plunger cycle by cycle (cycle meaning and up and down or down and up) and therefore always running the downhole tool (e.g., plunger) from the most ideal location. Stated another way, the disclosed downhole movement control system may be configured to allow a user to selectably identify or select a downhole tool tubing string stop point, such a point fixed or changing with time, production line condition, or other operating condition or system parameter condition or state.

Consider an example well with 8000 ft of tubing with high liquid production. Normally, one would wish to run a plunger from the lowermost point in the well. Attempts to do this may fail to provide the most efficient pumping due to a high liquid content relative to the available gas contributing to a lack of actual gas velocity at the bottom of the tubing. Analysis is performed (or guesswork and "experience" are applied) and a decision is made to set a spring assembly with a stop at 6000 ft depth. The plunger now runs effectively. Three months later, the well is underperforming, and new analysis (or guesswork or experience) indicates the plunger would run from a lower point in the well. Wireline intervention and temporary shut-in of the well are required to move the bottom spring to the new location at 7000 ft. The plunger performs adequately. Three months later, the same process as above suggests another setpoint for the bottom spring. All of these interventions require shutting the well in, deploying surface equipment such as wireline and physical re-setting of the downhole spring.

In contrast, using the downhole tool movement control system of the disclosure, all the same applies as above, except one sets a bottom spring assembly at the end of tubing at 8000 ft. The system controller of the disclosed downhole tool movement control system calculates the ideal point from where the plunger will run effectively. The well closes and the plunger falls to this depth, at which point the controller signals the tubing line pressure valve to open and rise velocity control is applied. The controller calculates this point based on the tubing parameters for every cycle, so the point from which one pumps could change on every cycle too. For example, the turn point could be 7000 ft on the first cycle then 6800 ft on the next and 7125 ft on the next, etc. As long as one is consistent with the turnaround point determination method and consistent with the desired rise velocity, one should be pumping with the plunger with optimized conditions for every cycle. Over time, if the well supports pumping from greater depths, then the controller will automatically track that downwards (or vice versa if this is the case). One could think of this as "auto-swabbing" as a feature of products to accomplish this.

Operating Scenario Three

The use of a supplemental gas volume supplied to the annulus of a well has been described above. The downhole tool movement control system of the disclosure enables a method to control injection gas for wells that require supplementary gas volume supplied from surface down the casing-tubing annulus. For example, assume a well similar to that of Scenario Two above, wherein over time the auto-swabbing has permitted the well to be pumped all the way to bottom. This has been accomplished while providing a fixed rate of gas injection from the surface. But here, we have progressed forward by some amount of time and the volume of gas injected is greater than what is actually required, resulting in higher than necessary gas injection costs (we have to use a motor-driven compressor at surface to supply this injection gas, which is an expense). The controller of the downhole tool movement control system may calculate the actual required volume of gas required at the end of tubing and provide a signal to the injection gas controller (e.g., a variable speed drive or motorized control valve, and/or the supplemental gas volume valve 234 or a supplemental gas volume EFM 235) to regulate the injection gas rate, providing "just the right amount" of gas injection to make the system operate effectively. This makes the entire system responsive to efficient pumping and efficient use of external energy sources.

Operating Scenario Four

The system may be used to detect a severely slowed or fully stopped downhole tool, such as a plunger. A stopped plunger, especially when unexpected or unintended, halts plunger lift operations and is therefore undesirable. A plunger may severely slow or stop due to any of several reasons, to include relatively tight sections in the tubing string (caused by, e.g., over-torquing of joints between tubing sections, out of roundness of tubing portions caused by e.g., wear, friction, or manufacturing anomalies, etc.)

Any of several components and methods of the downhole tool movement control system as described in the disclosure may be used to determine a plunger is stopped or operating at severely reduced velocity. For example, a set of sensors may be fitted to the tubing string, either at discrete locations or as a continuous sensor system along the tubing string to detect the presence, and therefore movement (or lack thereof), of an adjacent plunger. Also, as another example, the plunger itself may be fitted with a sensor that broadcasts a signal which may be interpreted to determine plunger location and/or velocity (e.g., change in location over a known time can allow calculation of speed, change in frequency with time enables doppler effect calculations to determine speed, etc.). Note that a plunger may also operate at reduced speed in portions of a tubing string due to tubing geometries, such as caused by varied tubing inclination or abrupt changes in tubing direction (termed "dogleg severity"). The disclosed downhole tool movement control system may detect or identify such deviations in plunger velocity.

As a result of detecting or identifying a plunger stop or otherwise reduced velocity, the downhole tool movement control system may take any of several actions. For example, the system may sound an alarm, open a main system control valve, shut the well, etc.

FIG. 6 provides a data table of calculations for various plunger operations. Generally, calculations are made under various line pressures (e.g., 1000, 150, etc.), various PBH (e.g., 1500, 750, etc.), to determine plunger speed at surface (i.e., at well head) and average plunger velocities. Each assume a plunger break-out speed (the speed required for a plunger to depart from a resting position at bottom of the hole) of 300 ft/min. It can be seen that in many situations, a plunger exceeds a typical operating speed range of 600-900 ft/min). If a plunger contacts a wellhead at dangerously high speeds, undesirable results may include: plunger damage, surface lubricator damage, wellhead damage and, on occasion, breach of the wellhead with attendant safety risks and potential uncontrolled discharge of well contents into the environment.

The above disclosure of the downhole tool movement control system operating on a single downhole tool may be applied to or configured as a multi-stage downhole tool movement control system operating on a set of downhole tools. FIG. 7 depicts a side view representation of one embodiment of a multi-stage downhole tool movement control system. FIG. 8 depicts a flowchart of one embodiment of a method of use of the multi-stage downhole tool movement control system of FIG. 7. Note that some steps of the method 800 of FIG. 8 may be added, deleted, and/or combined. The steps are notionally followed in increasing numerical sequence, although, in some embodiments, some steps may be omitted, some steps added, and the steps may follow other than increasing numerical order. Any of the steps, functions, and operations discussed herein can be performed continuously and automatically.

Generally, two or more downhole tools, such as plungers, are positioned in a tubing string, along with a partitioning tool between each pair of downhole tools. The partitioning tool defines or demarcates the tubing string into a stage above the portioning tool and a stage below. The downhole tools cooperate to lift fluid from within the tubing string to the wellhead. A downhole tool positioned below or at a relatively deeper well depth lifts accumulated fluid to the partition tool, wherein the partition tool receives the accumulated fluid and brings it into the stage above the partitioning tool, where the fluid is in turn lifted by another downhole tool positioned at the relatively shallower tubing location or stage. (See the above-cited U.S. Pat. No. 7,878,251 to Giacomino for further description of typical partitioning tool operations). The multi-stage downhole tool movement control system operates to control one or more of the downhole tools.

With attention to FIG. 7, one embodiment of a multi-stage downhole tool movement control system 700 (the "system") is depicted. The system is simplified for clarity; e.g., several components or features in the wellhead area are not shown but are similar to those described with respect to the above (single) downhole tool movement control system, such as FIGS. 2A, 2B, and 3. As another example, a set of sensors on the downhole tools and/or on the annulus or tubing string are not shown.

The multi-stage downhole tool movement control system 700 comprises a system controller 730, system database 731, modeling component 796, and system control device 739 (aka system valve 739).

The system controller 730 may comprise a computer processor, the computer processor having machine-executable instructions to operate aspects and/or functions of the multi-stage downhole tool movement control system. The system controller 730 may interact or integrate with the control computer or RTU to receive or read data from the RTU (and/or a SCADA or any other conventional processor associated with a typical well, as known to those skilled in the art). The system controller 730 also receives fixed well parameters, as described above (and other initialization and/or calibration data, as described with respect to step 806 of method 800). The system controller interacts with system database 731, modeling element 796 and a remote user device 732. The system database 731 may be a physical server and/or a cloud-based system.

The system valve 739 setting may comprise a set of settings, to include valve position, or valve flow rate setting (to achieve a selectable flow rate). The system valve 739 in some embodiments is any device that measures, adjusts, and/or controls flow and/or pressure associated with the system valve 739. The system valve 739 may be, for example, a pressure differential device, output voltage from a turbine meter, or any other flow measurement devices or methods known to those skilled in the art. The system valve 739, among other things, sets or influences fluid conditions within tubing string 718 as controlled by system controller 730. For example, the system valve 739 may inject gas into the tubing string at known pressures and/or flow rates, as controlled by system controller 730 by way of conduit 737.

The well comprises a tubing string 718 within a well casing 720. An annulus 721 is formed between the tubing string 718 and the well casing 720. The well is positioned to engage a formation 714. The depth of the well is defined by distance D from the start of the tubing string 718 (at the wellhead 719 area) downward (into the Earth) to deeper locations.

For simplicity, the multi-stage downhole tool movement control system 700 depicted in FIG. 7 shows two downhole tools and one partitioning tool. Such a configuration is termed a "2-stage" system. Other configurations are possible, such as more than two downhole tools, each pair of adjacent downhole tools separated by a portioning tool.

Downhole tool one 716 (aka tool one 716) operates with velocity $V_{T1}$ at a well or tubing string location $D_{T1}$. Downhole tool two 715 (aka tool two 715) operates with velocity $V_{T2}$ at a well or tubing string location $D_{T2}$. A tool may be positioned at well bottom, such as a bumper spring tool 713 at tubing string location $D_{BS}$. Partitioning tool 717 is positioned between tool one 716 and tool two 715 at tubing string location $D_{PT}$. Note that the locations of each of tool one 716, tool two 715, partitioning tool 717, and bumper spring tool 713 are defined at a position in the geometric midsection of the respect tool, and that other tool positions may be referenced.

The position of the partitioning tool 717 defines or demarcates the tubing string in stages or sections or partitions, namely a first partition 718-1 and a second partition 718-2. The first partition 718-1 spans from the start of the tubing string (at position D=0) to the top or upper surface of the partitioning tool 717. Downhole tool one 716 operates within first partition 718-1. The second partition 718-2 spans from the bottom or lower surface of the partitioning tool 717 to the top or upper surface of the bumper spring tool 713. Downhole tool two 715 operates within second partition 718-2.

The system 800 may comprise one or more additional tubing string system valves which set or influence fluid conditions at various locations of the well, such as at various locations in the tubing string. Specifically, tubing system valve 739-1, engaged with system controller 730 by way of conduit 737-1, engages tubing string 718 at an upper portion of the tubing string 718 near the wellhead 719.

Tubing system valve 739-2, engaged with system controller 730 by way of conduit 737-2, engages tubing string 718 at a tubing string 718 just above the partitioning tool 717. Tubing system valve 739-3, engaged with system controller 730 by way of conduit 737-3, engages tubing string 718 at a tubing string 718 just below the partitioning tool 717. And tubing system valve 739-4, engaged with system controller 730 by way of conduit 737-4, engages tubing string 718 at a tubing string 718 just above the bumper spring tool 713. Other locations for such additional system valves are possible, to include locations along annulus 721. (Note that the use of gas injection sites within the well enables "gas lift" operations, as referenced above).

The system controller 730 operates to control the various system valves 739, 739-1, 739-2, 739-3, 739-4, and/or any additional values (such as those described above in the single downhole tool movement control system embodiments) in any of several ways, to include on/off aka full open/full close control, proportional control, PID aka proportional-integral-derivative control, adaptive control, artificial intelligence or machine learning, adaptive control, stochastic control, and any control schemes known to those skilled in the art (to include control schemes identified above regarding controllers and/or control systems).

The multi-stage downhole tool movement control system 700 operates to control one or both of the downhole tool one 716 and the downhole tool two 715 in any of the manners described above with respect to the single downhole tool movement control system embodiments. For example, the system 700 may control one or both of the downhole tool one 716 and the downhole tool two 715 using modeling, downhole tool sensors or tubing string sensors, as described above. The system controller 730 controls the downhole tool one 716 within first partition 718-1 and/or the downhole tool two 717 within first partition 718-2.

As briefly mentioned, the multi-stage downhole tool movement control system 700 may be configured to operate a selected set of downhole tools positioned at respective stages or partitions of the tubing string. For example, in the 2-stage operation of FIG. 7, the system controller 730 may solely control the tool two 715 operating within the second partition 718-2, leaving the tool one 716 to operate freely within the first partition 718-1. As another example, again with respect to the 2-stage operation of FIG. 7, the system controller 730 may first control the tool two 715 until the tool two 715 engages with the partitioning tool 717 (wherein tool two delivers accumulated fluid to the partitioning tool 717), and then the system controller 730 may control the tool one 716 (upon any of several conditions, e.g., upon physical contact between tool two 715 and the partitioning tool 717, upon a selectable threshold separation distance between the two tools being breached, etc.). Such a switching of control between a tool positioned deeper in the well and one positioned immediately shallower in the well may be deemed sequential (tool) control. Other arrangements or cycles of tool control are possible and are selectable by a user.

In one embodiment, the multi-stage downhole tool movement control system operates to control a set or plurality of downhole tools without the use of any partitioning tools, the tools operating in zones of the tubing string. For example, the multi-stage downhole tool movement control system may be configured to operate with two downhole tools, i.e., a downhole tool one operating in a first zone and a downhole tool two operating in a second zone, without a partitioning tool positioned within the tubing strong to include a partitioning tool positioned between the two downhole tools. In such a configuration, the multi-stage downhole tool movement control system would control one or both of the two downhole tools in any of a variety of ways, e.g., as one tool at a time or in a coordinated manner such as in the sequential manner described above.

The downhole tools may be of varied configuration or characteristics. For example, the tools may all be identical bypass plungers with identical performance characteristics, the tools may be of similar types (e.g., all pad plungers) yet with different performance characteristics, or may be of different types (e.g., one tool may be a bypass plunger and another may be a pad plunger). Note that, as described above, a particular downhole tool may comprise performance characteristics that define, e.g., characteristic fall velocity and rise characteristics.

In one embodiment, a user may designate a condition upon which the multi-stage downhole tool movement control system switches control between downhole tools, such as, e.g., when one of the downhole tools reaches a selected position with the casing string, or upon reaching a threshold (minimal or maximal) velocity during lift operations, etc. The user may also designate or identify the demarcation between a first zone and a second zone of respective first and second downhole tools, such a demarcation may designate a condition upon which the multi-stage downhole tool movement control system switches control between downhole tools.

Note that well operations with multiple downhole tools, such as plunger lift tools, without any partitioning tools, has been performed in practice yet with essentially no control or limited control of one or more of downhole tools involved, and certainly not in the manner of the disclosed multi-stage downhole tool movement control system. An arrangement of multiple tools without any partitioning tools is not commonly used because of the inability to control one or more of the tools involved, such as the lower (i.e., the deepest) tool. For example, conventionally, in a two-plunger operation (without a partitioning tool), when the upper plunger arrives at the wellhead, the surface sensors trigger the next step in the (plunger lift) cycle, thereby unintentionally impacting the operation of the lower (i.e., the shallower) plunger and denying the ability of the lower plunger to complete its intended lift cycle.

In contrast, the multi-stage downhole tool movement control system may control the lower plunger and would continue to do so until the lower plunger completed its (lifting) cycle. Thus, the lower tool is allowed to travel to the well bottom, while the upper tool is still only part way down the well when the surface control valve is opened. The upper tool thus acts like the upper stage and removes liquid higher up in the well, taking advantage of favorable flow conditions higher in the well and relieving some of the load on the lower plunger, making it easier to lift accumulated fluid to the surface. Stated another way, the multi-stage downhole tool movement control system, by providing a precise location (and velocity) of the upper tool during the fall portion of a cycle, may selectively initiate the rise portion of the upper tool when the upper tool is in the best position to provide an effective contribution to the performance of the entire well system. In this manner, the multi-stage downhole tool movement control system operates a two-plunger system as though it was a two plunger, two-stage system, yet without a partitioning tool.

FIG. 8 depicts a flowchart of one embodiment of a method 800 of use of the multi-stage downhole tool movement control system, such as the multi-stage downhole tool movement control system 700 of FIG. 7. For simplicity, the method 800 is with respect to a two-stage system, i.e., one with two downhole tools and partitioning tool. Other configurations are possible, as described above.

The method 800 starts at step 804 and ends at step 844. After starting at step 804, the method 800 proceeds to step 806.

At step 806, the method 800 initialized the system. For example, well parameters, plunger parameters, and/or partition tool parameters may be obtained. The set of system parameters may be acquired by any of several means, to include one of more of the above-identified sensors and through the modeling element. The sensors may include, for example, a sensor that measures the gas (or other fluid) pressure at the bottom of the well, the line pressure at the wellhead, and/or line pressures at other locations along the production line. The system controller may establish initial system device setting(s). At the completion of step 806, the method 800 proceeds to step 808.

At step 808, a first downhole tool is positioned or disposed within the production string to operate within a production string first partition. The first downhole tool may travel to the bottom of the well and engage a tool, such as a bumper spring tool, positioned at the bottom of the well. At the completion of step 808, the method 800 proceeds to step 812.

At step 812, a partition tool is positioned or disposed at a defined location within the production string (above or at a shallower well depth than the first downhole tool). The partition tool thus defines or demarcates the first stage or first section or first partition of the production string (the section below the partition tool at a deeper depth) and the second stage or second section or second partition of the production string (the section above the partition tool at a shallower depth). At the completion of step 812, the method 800 proceeds to step 816.

At step 816, a second downhole tool is positioned or disposed within the production string to operate within the production string second partition. The second downhole tool may travel to the top of the well and engage a tool, such as a catching tool, positioned at the top of the well. At the completion of step 816, the method 800 proceeds to step 820.

At step 820, one or more system control devices are provided. Such a system device may be a master or central system valve positioned at the well head, such a system control device influencing or setting or other effecting the fluid conditions within the production string. In some embodiments, as described above with respect top system 700, additional system control devices are employed, such as one or more system control devices engaged with the annulus and/or the casing string. At the completion of step 820, the method 800 proceeds to step 824.

At step 824, a system controller is provided. The system controller, as described above, controls the one or more system control devices. At the completion of step 824, the method 800 proceeds to step 828.

At step 828, a user selects a particular downhole tool, or tools, for control by the system controller and the terms or operating conditions for that control. For example, a velocity schedule (as described above) may be selected, or a scheme for well control may be selected (e.g., the sequential control described above). The user may provide or enter such selections by way of a remote device, as described above. At the completion of step 828, the method 800 proceeds to step 832.

At step 832, the system determines initial system controller control outputs (to provide to the one or more system control devices) to achieve the user selected operating conditions for the particular or more downhole tools to be controlled. At the completion of step 828, the method 800 proceeds to step 836.

At step 836, the system controller adjusts controller outputs (to the one or more system control devices) to control the selected one or more downhole tools. At the completion of step 836, the method 800 proceeds to step 840.

At step 840, a query is made to the user (or if automated, a decision is reached per system schedule) if a different downhole tool is to be controlled. For example, a user may elect to first control the deepest (lower) downhole tool for a period of time, then elect to control a shallower (higher) downhole tool. As another example, in the sequential operation described above, the query may be automatically answered once a trigger event occurs, e.g., once the deepest (first) downhole tool operating in partition one reaches the partition tool, control switches from control of the first tool to control of the second tool (in the shallower or second partition). If the response to the query of step 840 is Yes, the method 800 proceeds to step 828. If the response to the query of step 840 is No, the method 800 proceeds to step 844 and the method 800 ends.

Other embodiments and/or applications of the downhole tool movement control system and/or method of use, and of the multi-stage downhole tool movement control system and/or method of use, are possible. For example, the system and/or method may be used to control a gas-liquid mixture velocity, even without a downhole tool in the well. Such is an aspect of the various embodiments of a system and method of maintaining minimal wellbore lift conditions through injection gas regulation, as described in FIGS. 9-13.

Figure 9:
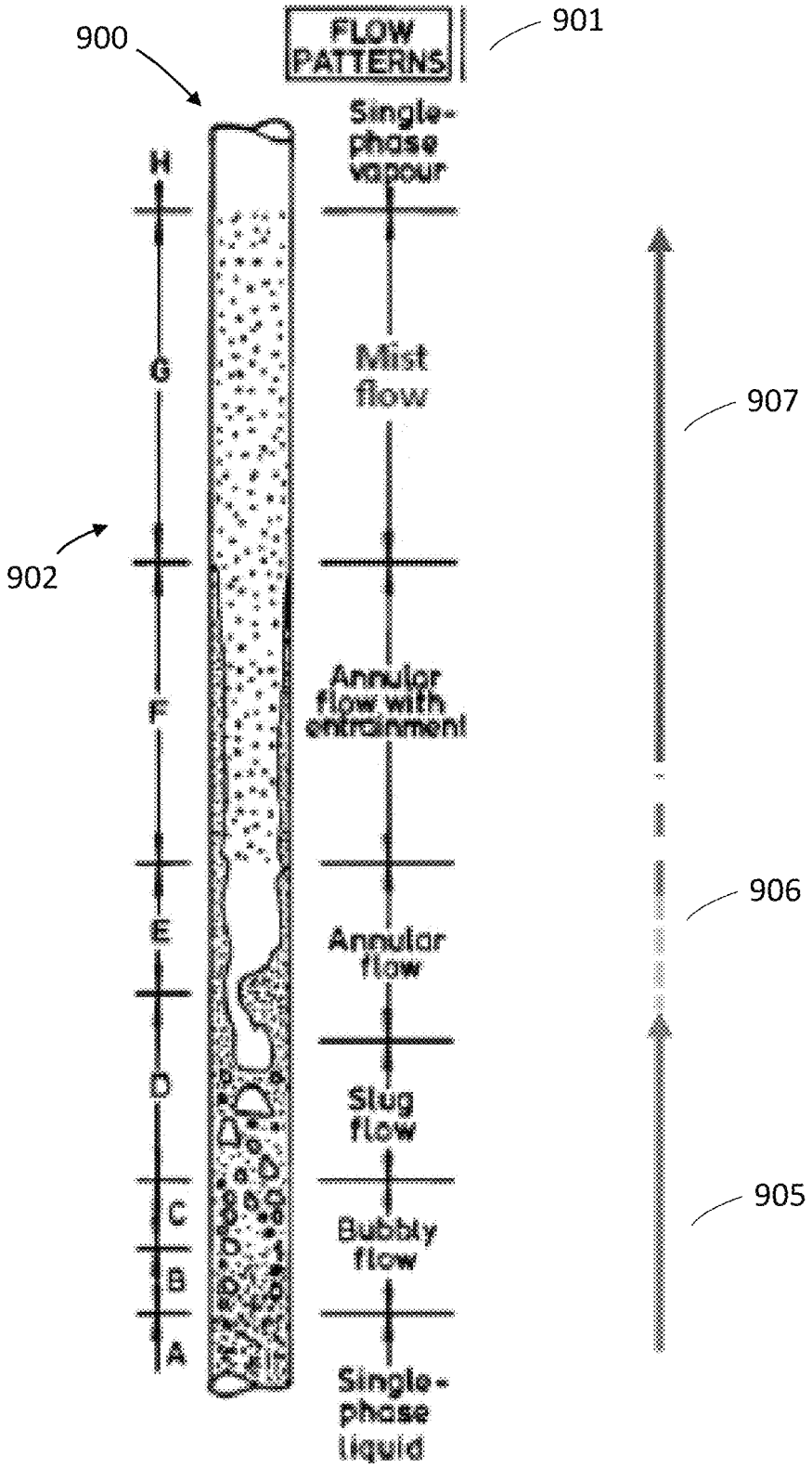
Fig. 9 (Prior Art)
FIG. 9 is a side view cut-away representation of flow patterns within a production string of the prior art.
Figure 10:
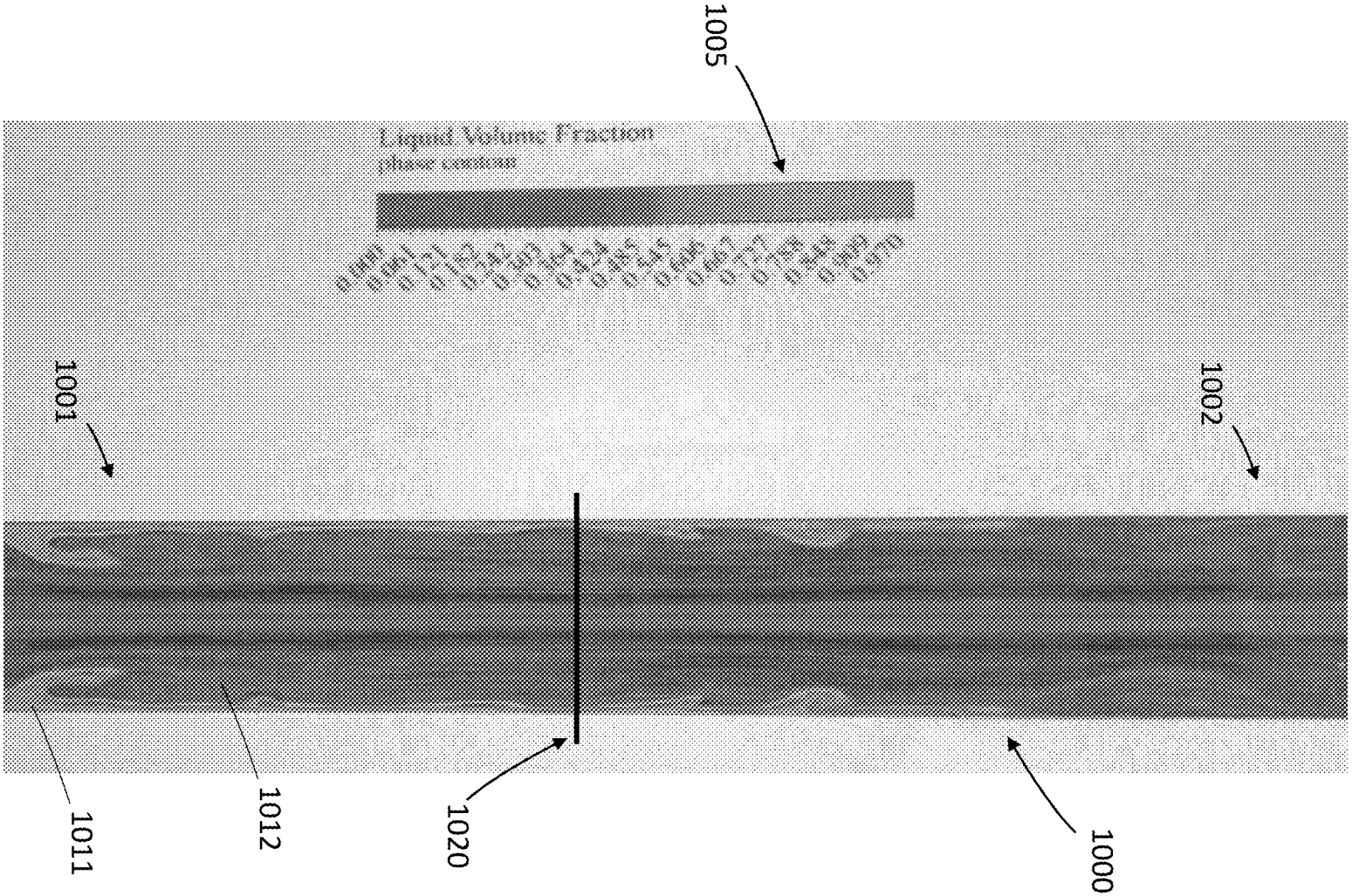
Fig. 10 (Prior Art)
FIG. 10 is a side view cut-away representation of a computational fluid dynamics simulation of flow patterns within a production string of the prior art.
Figure 11:
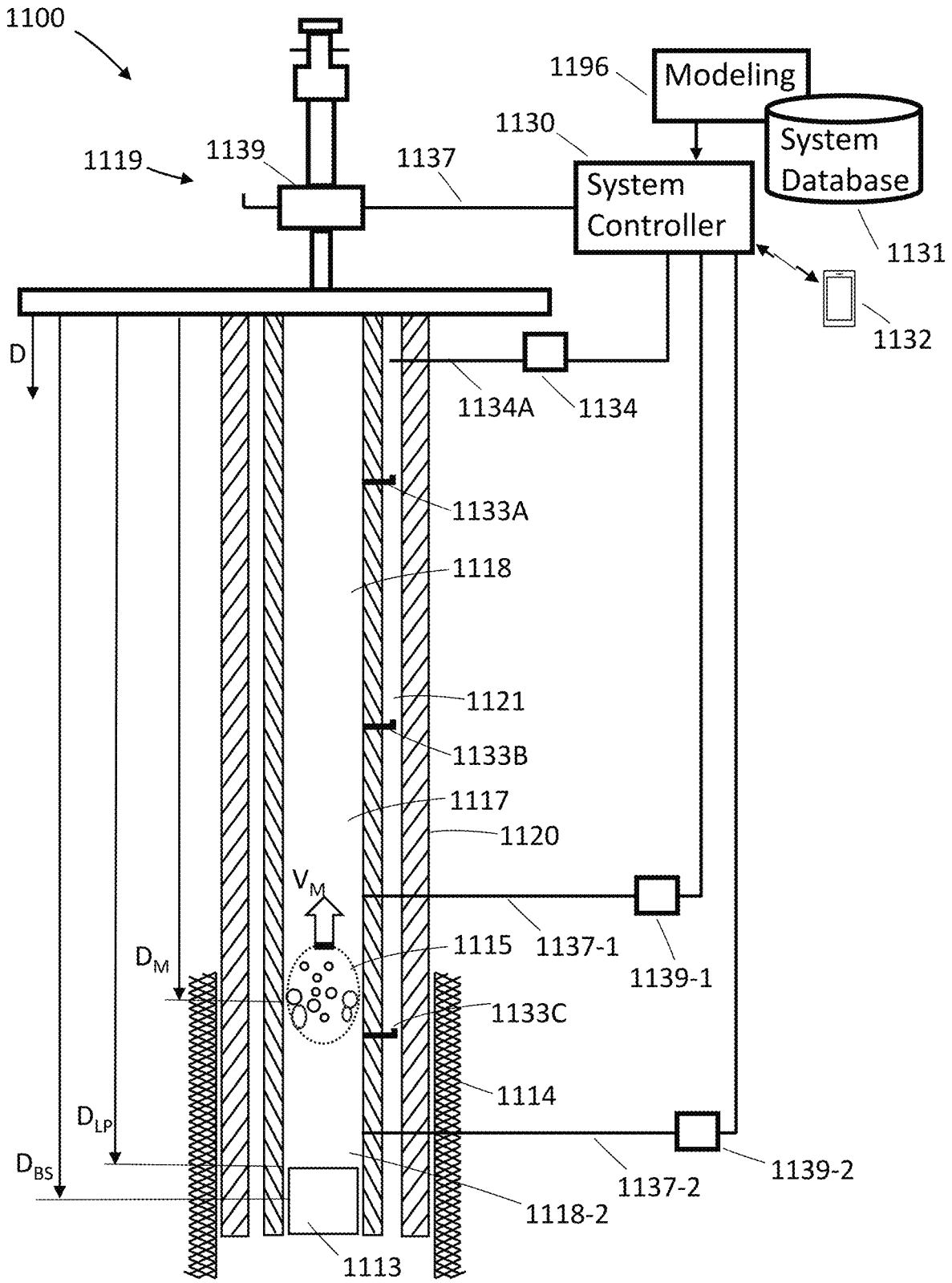
FIG. 11 depicts a side view representation of one embodiment of a launch point lift gas velocity control system of the disclosure.
Figure 12:
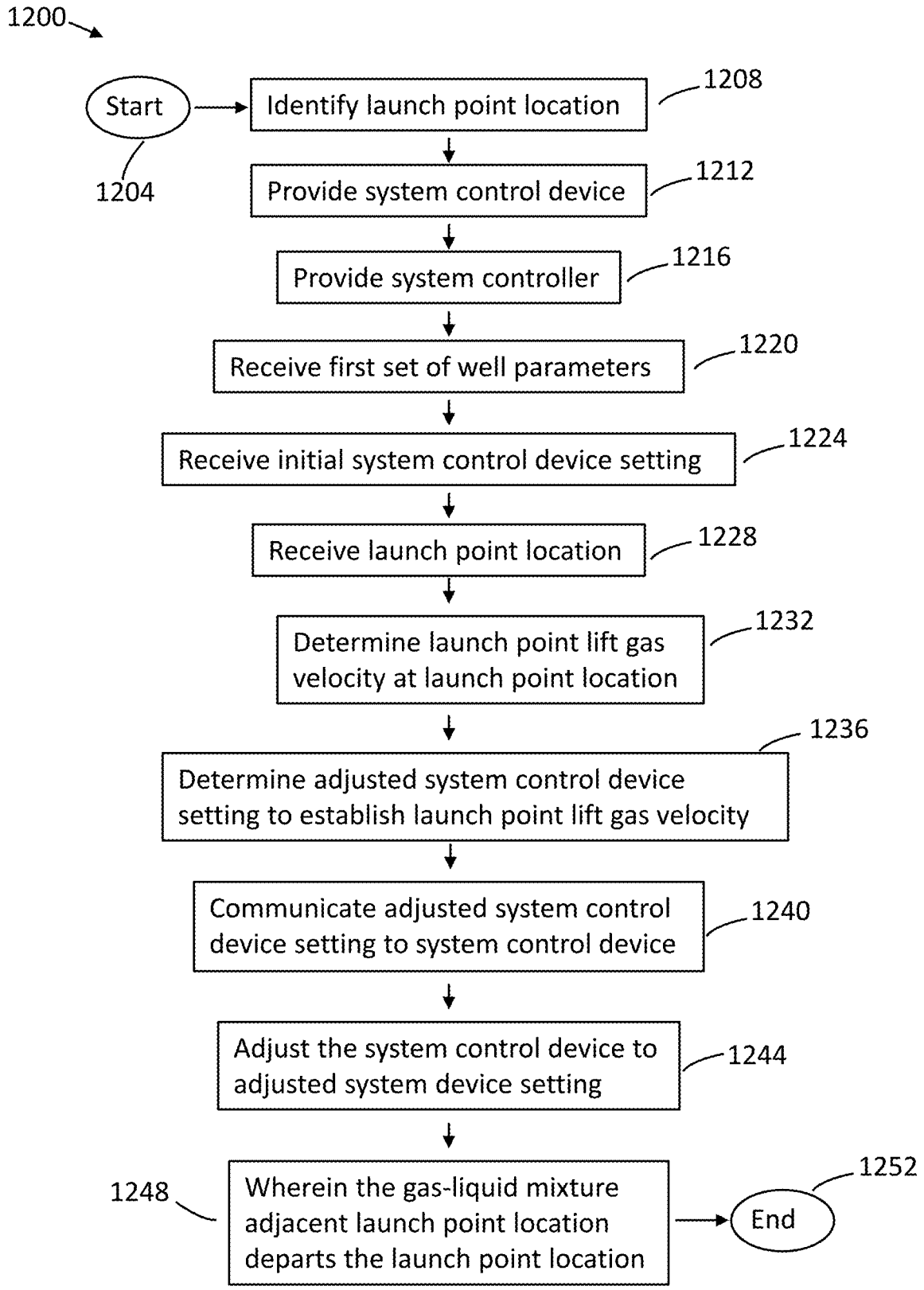
FIG. 12 depicts a flowchart of one embodiment of a method of use of the launch point lift gas velocity control system of FIG. 11.
Figure 13:
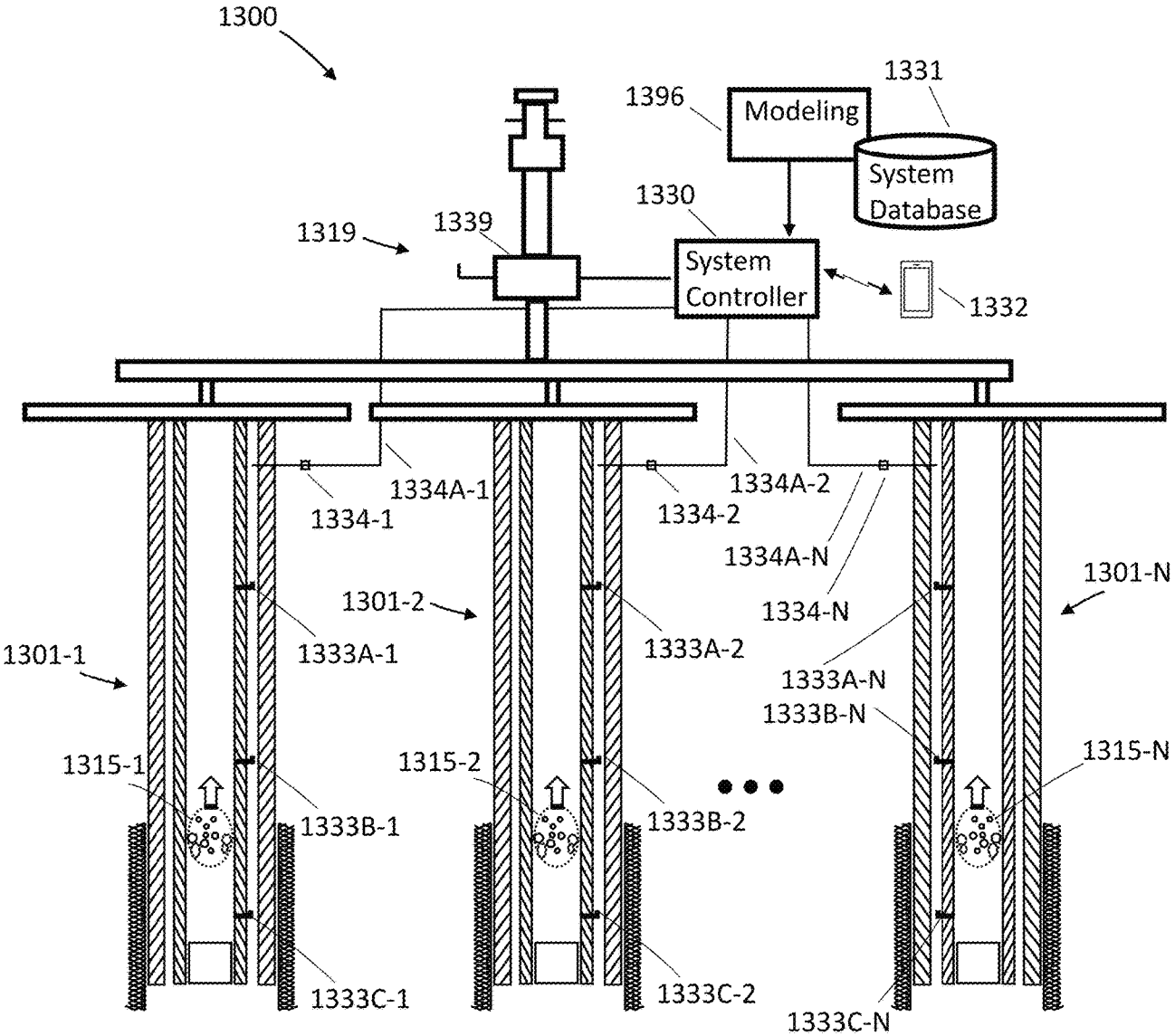
FIG. 13 depicts a side view representation of one embodiment of a launch point lift gas velocity control system operating multiple wells grouped on a common pad which feed a common discharge line.

FIGS. 9 and 10 depict flow patterns within a production string of the prior art, illustrating various combinations or states of a gas-liquid mixture within a production string. FIGS. 11 and 12 depict one embodiment of a respective launch point lift gas velocity control system and method of use of a launch point lift gas velocity control system. FIG. 13 describes one embodiment of a launch point lift gas velocity control system in an environment of multiple wells grouped on a common pad which feeds a common discharge line.

FIG. 9 of the prior art depicts flow patterns within a production string 900. Generally, conditions within a production string of a well casing may result in a variety of flow patterns and gas-liquid mixtures along the length or depth of a well. The production string is shown with eight (8) regions 902, identified as lettered regions A-H, with different flow patterns, although the flow patterns blend together in a continuous manner and are not discrete regions. The different flow patterns may exist even at a constant gas flow rate as measured at surface. This is due to compression of the gas phase from surface to the bottom of the production string while liquid remains virtually incompressible, reducing the actual proportions of gas to liquid with depth.

The patterns of FIG. 9 are for illustrative purposes; actual wells may have fewer regions or may not have some regions shown or have regions not described or shown. Yet at least some of the regions of FIG. 9 are typically found in actual wells during well life. At the deepest region A the gas-liquid mixture within the production tubing is a single-phase liquid. At the shallowest region H the gas-liquid region is a single-phase vapor. Note the regions E and F, respectively annular flow and annular flow with entrainment, in which a liquid attaches to the inside diameter of the production tubing.

The zones 905-907 depict zones of relative effectiveness for plunger operation, which are directly correlated to the adjacent gas-liquid regions A-H.

The zone 905 has very high levels of liquid. A downhole plunger at times will not function under such conditions. In some circumstances, if liquid rates are sufficiently high, the liquid may push a plunger upwards.

The zone 906 is a transitional region from the liquid-dominated zone 905 to the gas-dominated zone 907. A downhole plunger is typically able to serve as a pump to move liquids upwards. The location of this zone depends particularly on gas liquid ratio ("GLR"), surface pressure, gas rate, and plunger design.

The zone 907 is very favorable to downhole plunger operations and plunger lifting of liquids upwards. The zone is disposed at a point higher in the well than at full depth in wells with lower GLR.

FIG. 10 of the prior art is computational fluid dynamics ("CFD") simulation of flow patterns within a production string 1000. The CFD simulation is of two-phase (air and water) vertical flow within a three (3) inch pipe (simulating a production string). Water is injected radially at the bottom or lower portion 1001 and air is injected axially up the center from the bottom or lower portion 1001.

The flow is from the bottom or lower portion 1001 of the production string 1000 to the top or upper portion 1002 of the production string 1000. A liquid volume fraction (between 0.0 and 1.0) is depicted by shading 1005. The area 1011 (along the string wall) is in the higher range of liquid volume fraction (it is essentially all liquid), while the area 1012 (in the interior of the string) is in the lower range of liquid volume fraction (it is highly gaseous). Any given cross-sectional area, such as the cross-sectional area 1020, of the production string 1000 will comprise or form or define a gas-liquid mixture, such a gas-liquid mixture having a liquid volume fraction.

FIG. 11 depicts a side view representation of one embodiment of a launch point lift gas velocity control system. FIG. 8 depicts a flowchart of one embodiment of a method of use of the launch point lift gas velocity control system of FIG. 11. Note that some steps of the method 1200 of FIG. 12 may be added, deleted, and/or combined. The steps are notionally followed in increasing numerical sequence, although, in some embodiments, some steps may be omitted, some steps added, and the steps may follow other than increasing numerical order. Any of the steps, functions, and operations discussed herein can be performed continuously and automatically.

Generally, the launch point lift gas velocity control system operates to maintain minimal well bore lift conditions through injection gas regulation. In one aspect, the minimal wellbore conditions enable a gas-liquid mixture or a downhole tool at a selectable well bore launch point to depart from a targeted launch point lift gas velocity in a free-cycle environment. The launch point may be adjusted to account for variability with time and wellbore location. The phrase "launch point" means a selectable position of a gas-liquid mixture within a well bore or tubing string that is sought to receive a particular lift gas velocity that will cause the gas-liquid mixture to depart or launch from the launch point location and freely ascend or rise within the well bore or tubing string without further adjustment of well bore conditions. The phrase "launch point lift gas velocity" is the above identified particular lift gas velocity to cause such a gas-liquid mixture launch.

With attention to FIG. 11, one embodiment of a launch point lift gas velocity control system 1100 (the "system") is depicted. The system is simplified for clarity; e.g., several components or features in the wellhead area are not shown but are similar to those described with respect to the above (single) downhole tool movement control system, such as FIGS. 2A, 2B, and 3, and the multi-stage downhole tool movement control system 700 of FIG. 7. As another example, a set of sensors on the downhole tools and/or on the annulus or tubing string are not shown.

The launch point lift gas velocity control system 1100 comprises a system controller 1130, system database 1131, modeling component 1196, and system control device 1139 (aka system valve 1139).

The system controller 1130 may comprise a computer processor, the computer processor having machine-executable instructions to operate aspects and/or functions of the launch point lift gas velocity control system 1100. The system controller 1130 may interact or integrate with the control computer or RTU to receive or read data from the RTU (and/or a SCADA or any other conventional processor associated with a typical well, as known to those skilled in the art). The system controller 1130 also receives fixed well parameters, as described above (and other initialization and/or calibration data, as described with respect to method 1200). The system controller interacts with system database 1131, modeling element 1196 and a remote user device 1132. The system database 1131 may be a physical server and/or a cloud-based system.

The system valve 1139 setting may comprise a set of settings, to include valve position, or valve flow rate setting (to achieve a selectable flow rate). The system valve 1139 in some embodiments is any device that measures, adjusts, and/or controls flow and/or pressure associated with the system valve 1139. The system valve 1139 may be, for example, a pressure differential device, output voltage from a turbine meter, or any other flow measurement devices or methods known to those skilled in the art. The system valve 1139, among other things, sets or influences fluid conditions within tubing string 1118 as controlled by system controller 1130. For example, the system valve 1139 may inject gas into the tubing string at known pressures and/or flow rates, as controlled by system controller 1130 by way of conduit 1137.

The well comprises a tubing string 1118 within a well casing 1120. An annulus 1121 is formed between the tubing string 1118 and the well casing 1120. The well is positioned to engage a formation 1114. The depth of the well is defined by distance D from the start of the tubing string 1118 (at the wellhead 1119 area) downward (into the Earth) to deeper locations.

A targeted gas-liquid mixture 1115 is depicted at a well or tubing string location $D_M$. The gas-liquid mixture 1115 has a velocity $V_M$ at the well or tubing string location $D_M$. The gas-liquid mixture travels within the well or tubing string and may be positioned at a particular launch point location, depicted as $D_{LP}$. (In FIG. 11, the gas-liquid mixture 115 is depicted having already been launched at a launch point velocity from launch point location $D_{LP}$. A tool may be positioned at well bottom, such as a bumper spring tool or one-way check valve device 1113 at tubing string location $D_{BS}$.

The system 1100 may comprise one or more additional tubing string system valves which set or influence fluid conditions at various locations of the well, such as at various locations in the tubing string. Specifically, tubing system valve 1139-1, engaged with system controller 1130 by way of conduit 1137-1, engages tubing string 1118 at lower half portion of the tubing string 1118. Tubing system valve 1139-2, engaged with system controller 1130 by way of conduit 1137-2, engages tubing string 1118 at a at a distal end of the tubing string just above the bumper spring 1113. Other locations for such additional system valves are possible. For example, tubing system valves may engage the tubing string in other locations of the tubing string, to include more proximal locations such as just below the wellhead.

The system controller 1130 operates to control the various system valves 1139, 1139-1, 1139-2, and/or may control some additional valves (such as those described above in the single downhole tool movement control system embodiments) in any of several ways, to include on/off aka full open/full close control, proportional control, PID aka proportional-integral-derivative control, adaptive control, artificial intelligence or machine learning, adaptive control, stochastic control, and any control schemes known to those skilled in the art (to include control schemes identified above regarding controllers and/or control systems).

The system also comprises elements to provide or enable conventional "gas lift" to include valve elements relating to gas flow conditions in the well annulus 1121. Specifically, annulus injection valve 1134 via associated annulus control valve conduit 1134A provides gas to the annulus, such gas interacting with one or more downhole injection valves. In the configuration of FIG. 11, the system 1100 comprises a set of three downhole injection valves 1133A, 1133B, and 1133C. The downhole injection valves 1133A, 1133B, and 1133C operate in a well-known process (to those skilled in the art) in which a given downhole injection valve subject to flow conditions in the annulus and within the production tubing operate so as to artificially lift liquid contained within the production tubing.

(Generally, conventional gas lift relies on injection pressure at the surface to determine whether a given valve is open or closed. Gas is injected down the annulus, and the valves begin in the open state. If the wellbore begins filled with liquid, the easiest path for the gas is through the uppermost valve. It will flow this way until sufficient liquid is removed and injection pressure goes down. As liquid is removed and injection pressure reduces, the next valve down begins to flow and the valve above closes. This sequence repeats until all "unloading valves" have performed their task and the well is injecting gas from the production valve or the end of tubing).

In the launch point lift gas velocity control system 1100, in one embodiment, one or more downhole injection valves (e.g., 1133A, 1133B, and 1133C) in concert with an annulus injection valve (e.g., 1134) are employed to maintain or establish or set the desired launch point lift gas velocity at a selected launch point location. Stated another way, the annulus injection valve may control gas injection volumetric rates which in turn, by way of the operation of one or more downhole injection valves, maintains the desired launch point lift gas velocity at a selected launch point location. The operation, e.g., control of or setting of, the annulus injection valve 1134 is by way of system control 1130.

Note that many configurations, e.g., number and location, of downhole injection valves are possible, such as downhole injection valves located at additional or fewer intervals along tubing string 1118. The gas injected by the annulus injection valve 1134 may be supplied in any number of ways, including as a stand-alone supply, from a gas compressor (see, e.g., gas compressor 238 in FIG. 2B) and/or by way of the well. For example, the supplemental gas may be supplied by way of a downstream separator which recirculates gas back into the well. Note that the wellhead portion of the launch point lift gas velocity control system 1100 has been simplified for clarity. For example, the launch point lift gas velocity control system 1100 may comprise a production line injection valve, similar to production line injection valve 224 of FIG. 2B. The system controller 1130 comprises a system processor. The system processor executes machine-executable instructions directly or by way of communicating those instructions to other elements of the launch point lift gas velocity control system 1100, such as communicating instructions for execution to one or more system control devices such as one or more system valves.

The system controller 1130 operates to control a launch point lift gas velocity $V_M$ of a gas-liquid mixture 1115 at a launch point location $D_{LP}$ of a production string or well casing tubing string 1118 within a well casing 1120. (In one embodiment, a production string is one of a tubing string and a casing string).

Among other things, the system controller executes machine-executable instructions to receive well parameters, to include a first set of well parameters. In one embodiment, the set of well parameters may be those described above in other embodiments of systems (to include, e.g., the downhole tool movement control system), such as a production string inner diameter, a production string pressure, a line pressure, a gas rate, a liquid/gas ratio, a depth to a bottom hole assembly, a pressure in the first production string section associated with a wellhead portion of the production string, a pressure in the second production string section associated with a bottom hole assembly, and a bottom hole pressure.

Further, among other things, the system controller executes machine-executable instructions to receive additional system data, such as system control device settings to include, e.g., an initial system control device setting, and launch point location data. The system controller is configured to: determine a launch point lift gas velocity at the launch point location (the launch point lift gas velocity enables the gas-liquid mixture adjacent the launch point location to depart the launch point location, determine an adjusted system control device setting (adjusted relative to existing or current system control device(s) setting(s)) that establishes the launch point lift gas velocity at the launch point location, and to communicate the adjusted system control device setting to the system control device (the system control device then adjusting the system control device setting from the existing or current (e.g., the initial) system control device setting to the adjusted system control device setting).

In one embodiment, the setting or establishment of a particular launch point lift gas velocity at a particular launch point location is established by either or both of: the well sales valve and one or more injection valves.

The system processor of the system controller 1130 determines a launch point lift gas velocity at the launch point location based on, among other things, the set of well parameters. Other mechanisms or approaches to determining a launch point velocity may be used, to include similar approaches described above in other embodiments of systems (to include, e.g., the downhole tool movement control system). (References to previously described embodiments to include previously described figures will be made).

The launch point lift gas velocity control system 1100 has a set of system parameters. The system parameters may include both well parameters and gas-liquid mixture parameters. The set of system parameters may be acquired by any of several means, to include one or more of the above-identified sensors and/or other sensors (see, e.g., 285 in FIG. 2B) and through the modeling 1196 element. Other sensors may include, for example, a sensor that measures the gas (or other fluid) pressure at the bottom of the well, i.e., the $P_{BH}$, the line pressure at the wellhead 219, and/or line pressures at other locations along the production line.

The system parameter element may also receive system parameters from modeling element 1196, which may model various system parameters, such as modeling of fluid pressures and/or fluid velocities.

Any number or variety of modeling techniques may be used, to include deterministic modeling, classic Newtonian modeling, stochastic modeling, multiphase flow modeling, adaptive modeling to include artificial intelligence and machine learning, computational fluid dynamic modeling, and/or modeling techniques known to those skilled in the art. The system (well) parameters may include fluid pressures and/or fluid velocities in the tubing string at one or more locations to include the launch point location $D_{LP}$, fluid properties such as temperature, fluid dynamic conditions, and gas/liquid mixtures such as proportion of gas to liquid. The system (gas-liquid mixture) parameters may include gas-liquid mixture speeds or gas-liquid mixture velocities, and/or gas-liquid mixture modeled or nominal velocity $v_m$ for given well conditions (such as, e.g., average well tubing pressure). Note that one or more of the system parameters may vary with position in the production line, e.g., a gas-liquid mixture speed typically varies with position in the production line and may reach a peak at an intermediate position within the production line or near/adjacent the upper portion of the production line.

In one embodiment, the system (gas-liquid mixture) parameters include $v_m$ as modeled over a portion or entirety of the well, for a given set of well conditions, as provided by a model of gas-liquid mixture kinematics. The fall rate (or rise rate) may be calculated or modeled using any method known to those skilled in the art, to include by way of CFD modeling techniques. In one embodiment, the fall rate and/or rise rate of a given gas-liquid mixture may be determined with input of one or more of the following parameters: tubing Pressure (psig), temperature, tubing Size, SG (specific gravity) of Gas, SG of Liquid, depth of end of tubing (EOT) (ft), Average Barrels of Liquid Per Day (bbls/day), Trips Per Day, plunger type, tubing pressure, casing pressure, gas injection pressure, gas injection volumetric rate, input depth of tubing the plunger will travel, number of barrels per day of liquid produced, and number of trips per day the plunger makes.

The modeling may be combined or augmented by measurements, such as measurements provided by the one or more well sensors or gas-liquid mixture sensors. (Recall the term "modeling" means a mathematical or logical representation of a system, process, or phenomena, such as a mathematical representation of the kinematics of a plunger operating within a production line given operation conditions). Modeling therefore includes without limitation, any method of calculating or predicting flowing gas-liquid mixture parameters in the well, particularly in the physical proximity of the launch point location during movement or intended movement of the gas-liquid mixture, such as multiphase flow correlations known to those skilled in the art, and Machine Learning or Artificial Intelligence-based methods to obtain similar flowing fluid parameters.

The kinematics of the gas-liquid mixture (to include in particular gas-liquid mixture velocity at one or points within the tubing string and/or gas-liquid mixture location at one or points within the tubing string, through techniques to include sensor measurements and/or modeling), are thus monitored and/or predicted for use by the system. The gas-liquid mixture kinematics are controlled by the system so as to launch the gas-liquid mixture from or at the launch point location. Such gas-liquid mixture kinematics may comprise actual or sensed gas-liquid mixture kinematic profiles and/or predictive gas-liquid mixture kinematic profiles. Other gas-liquid mixture characteristics and/or production line parameters and/or system parameters may also be observed, sensed, and/or predicted, such as production line fluid pressures at one or more positions of the production line, production line fluid temperatures at one or more positions of the production line, and the like. A given set of system parameters, to include the gas-liquid mixture kinematics aka gas-liquid mixture parameters, may be controlled by the gas-liquid mixture system (with controllability achieved through operation or control of the various system valve 224' and one or more of valves 224, 244, 234), by any number or set of control techniques using any number of or set of control parameters. For example, gas-liquid mixture launch velocity may be controlled through classic feedback control techniques using gas-liquid mixture internal flow control mechanisms (e.g., mechanisms that control flow through the gas-liquid mixture which will influence the gas-liquid mixture speed) that slows or speeds up the gas-liquid mixture velocity. Other control techniques are possible, such as those mentioned above, e.g., deterministic control, adaptive control, etc. Other control parameters, alone or in combination are also possible, to include control, monitoring, sensing, and/or modeling of production line parameters, to include, e.g., fluid temperature, fluid pressure, etc. at one or more positions in the production line.

In one embodiment, one or more of the set of system parameters 295 may be obtained through one or more sensors disposed on or near the production line or on or near the wellhead, as described by, for example, in Bender.

The system (well) parameters 295 may include any of several characteristics of well operations, such as, for example: makeup of gas and liquids (stated another way, the relative proportion of gas and liquid), well bottom temperature, fluid phases or mixtures thereof, fluid characteristics such as density, viscosity, pressure, speed/velocity, etc.; physical characteristics of the tubing string e.g. diameter, tubing material, tubing condition (new, corrosion, erosion), depth of tubing placement, inclination, and tortuosity; surface conditions e.g. wellhead temperature, piping and valve arrangements, gathering or receiving system pressures and temperatures, production line pressure at or near the wellhead (e.g. production gas pressure, production liquid pressure, production gas/liquid pressure) which may be measured by electronic flow meters (EFM) 225, 235, 245 (see FIG. 2B); downhole conditions such as gas pressure within the tubing string at one or more locations or depths within the tubing string or within the annulus, gas velocity or gas speed within the tubing string at one or more locations or depths within the tubing string or within the annulus; and gas-liquid mixture parameters such as gas-liquid mixture speed, gas-liquid mixture location, and ideal or optimal gas-liquid mixture speed given tubing string or other well conditions. Any set or all of the system parameters may vary with location in the production string. In one embodiment, the production string is a casing string. In one embodiment, the production string is a tubing string. In one embodiment, the production string is a tubing string, the tubing string positioned within a casing string.

Generally, once the system control device setting is adjusted to a setting that establishes the launch point lift gas velocity at the launch point location, the gas-liquid mixture launches or departs from the launch point as a launched gas-liquid mixture that achieves the launch point lift gas velocity. The launched gas-liquid mixture ascends the production string without further adjustment of system control device(s). In one embodiment, the gas-liquid mixture travels substantially the entire distance of the production string, e.g., from a production string section associated with a bottom hole assembly to a production string section associated with the wellhead portion of the production string.

Note that as the launched gas-mixture travels (e.g., ascends) within the production string, the launched gas-liquid mixture velocity will vary due to, e.g., the reduction in pressure and corresponding increase in gas relative to liquid as the mixture approaches the surface. Also, a determined gas-mixture launch velocity for a particular launch point is not static but rather will vary with time due to, e.g., surface pressure changes. As such, a first launch point lift gas velocity at a targeted launch point location as applied to a first gas-liquid mixture to create a first launched gas-liquid mixture may be different than a second launch point lift gas velocity at the same targeted launch point location, the second launch point lift gas velocity applied to a second gas-liquid mixture to create a second launched gas-liquid mixture.

In one embodiment, a downhole tool (such as a plunger) is positioned within the production string adjacent or within the gas-liquid mixture, the downhole tool having a set of downhole tool parameters as described above (e.g., with respect to the downhole tool movement control system embodiments). Such a downhole tool would operate or move within the production string in concert with the launched gas-liquid mixture, to include ascending the production string without further adjustment of the system control device(s). In one embodiment, the downhole tool (as coupled with the launched gas-liquid mixture) travels substantially the entire distance of the production string, e.g., from a production string section associated with a bottom hole assembly to a production string section associated with the wellhead portion of the production string. (The downhole tool, to include a plunger downhole tool, may be any of the types described above, and possess characteristics as described above).

FIG. 12 depicts a flowchart of one embodiment of a method of use 1200 of the launch point lift gas velocity control system, such as the launch point lift gas velocity control system of FIG. 11. The method 1200 starts at step 1204 and ends at step 1252. After starting at step 1204, the method 1200 proceeds to step 1208.

At step 1208, a desired launch point location within the production string is identified. The launch point may be provided by a user such as by device 1132 or automatically, such as by system controller 1130. After completing step 1208, the method 1200 proceeds to step 1212. At step 1212, a system control device as described above is provided. After completing step 1212, the method 1200 proceeds to step 1216.

At step 1216, a system controller as described above is provided. After completing step 1216, the method 1200 proceeds to step 1220.

At step 1220, a set of well parameters, such as a first set of well parameters, is received by the system controller. The set of well parameters may comprise well parameters as described above. After completing step 1220, the method 1200 proceeds to step 1224.

At step 1224, the system controller receives system control device setting(s), such as an initial system control device setting. The system control device setting(s) may comprise setting(s) as described above, e.g., valve setting(s). After completing step 1224, the method 1200 proceeds to step 1228.

At step 1228, the system controller receives the launch point location. After completing step 1228, the method 1200 proceeds to step 1232.

At step 1232, the system controller determines the launch point lift gas velocity at the launch point location, the launch point lift gas velocity associated with or particularized for a gas-liquid mixture adjacent or near or surrounding the launch point location. After completing step 1232, the method 1200 proceeds to step 1236.

At step 1236, an adjusted system control device setting is determined, the adjusted system control device setting being a setting that will enable the gas-liquid mixture adjacent the launch point to depart the launch point. The adjusted system control device setting is adjusted in that it is typically different than the notional or initial system control device setting (as received at step 1224). After completing step 1236, the method 1200 proceeds to step 1240.

At step 1240, the adjusted system control device setting is communicated, by the system controller, to the system control device. After completing step 1240, the method 1200 proceeds to step 1244.

At step 1244, the system control device adjusts or alters its setting to the adjusted system control device setting. After completing step 1244, the method 1200 proceeds to step 1248.

At step 1248, the gas-liquid mixture that is disposed or positioned adjacent or near the launch point location departs or launches from the launch point location as a launched gas-liquid mixture. The launched gas-liquid mixture achieves the launch point lift gas velocity and proceeds to travel up or ascend the production tubing. At the completion of step 1248, the method 1200 proceeds to step 1252 and the method 1200 ends.

Note that the method 1200 depicts a launching of a single gas-liquid mixture at a single launch point location. The method 1200 may readily be applied in a repetitive manner to launch a sequence of gas-liquid mixtures at the same launch point location or to launch a sequence of gas-liquid mixtures at different launch point locations. The method 1200 must simply receive appropriate or updated operational parameters (e.g., the launch point location, system conditions such as well bore conditions, system control device settings, etc.) to establish or control launch point lift gas velocities for a sequence of gas-liquid mixtures at the same launch point location or to establish or control launch point lift gas velocities for a sequence of gas-liquid mixtures at different or varied launch point locations.

FIG. 13 depicts a side view representation of one embodiment of a launch point lift gas velocity control system 1300 operating N number of multiple wells (1301-1, 1301-2, 1301-N) grouped on a common pad which feeds a common discharge line at system valve 1339. (The well head area of the launch point lift gas velocity control system 1300 is simplified for clarity).

Generally, wells that are grouped on a pad and which feed into a common discharge line or where the discharge lines are connected together from different pads or wells upstream of a compression facility are challenging to operate optimally. Due to the cyclic nature of operating wells with outflows ranging from zero to some very large flowrates, the discharge pressure a single well must operate against varies considerably as the gathering system line is fed varying volumes of gas. This impacts the flow patterns or regimes in that well and injecting gas (in a conventional gas lift operation—see above descriptions regarding gas lift) at a constant rate (the current practice) doesn't provide a constant lift environment downhole for the set of wells. Stated another way, the discharge from each well is comingled downstream at some point. The effect of varying flow rates which combine at the comingling point will impact the pressure in the collecting piping, and create varying tubing pressures at each respective wellhead. This in turn affects the pressure through the depth of tubing to the launch point, and as a result requires changes to the injection volumetric rate and pressure to adapt the launch conditions to maintain lift.

The launch point lift gas velocity control system 1300 addresses this shortcoming and provides for a dynamic adjustment to the lift gas velocity downhole for each well to maintain minimum lift conditions for a gas-liquid mixture tuned to each of the set of wells (and also for a downhole tool such as a plunger, the downhole tool optionally installed adjacent a targeted gas-liquid mixture). Stated another way, the launch point lift gas velocity control system 1300 manages the launch point velocity of each of the N wells by regulating injected gas flow into each annulus on a per well basis.

The launch point lift gas velocity control system 1300 comprises wells 1301-1, 1301-2, 1301-N. Well 1301-1 has annulus injection valve 1334-1 and associated annulus control valve conduit 1334A-1. The annulus injection valve 1334-1 provides gas to the annulus of well 1301-1 to operate the set of downhole injection valves 1333A-1, 1333B-1, and 1333C-1. Similarly, Well 1301-2 has annulus injection valve 1334-2 and associated annulus control valve conduit 1334A-2. The annulus injection valve 1334-2 provides gas to the annulus of well 1301-2 to operate the set of downhole injection valves 1333A-2, 1333B-2, and 1333C-2. And well 1301-N has annulus injection valve 1334-N and associated annulus control valve conduit 1334A-N. The annulus injection valve 1334-N provides gas to the annulus of well 1301-N to operate the set of downhole injection valves 1333A-N, 1333B-N, and 1333C-N.

Each of the N wells has an associated gas-liquid mixture at a launch point location: well 1301-1 has gas-liquid mixture 1315-1, well 1301-2 has gas-liquid mixture 1315-2, and well 1301-N has gas-liquid mixture 1315-N.

The launch point lift gas velocity control system 1300 operates to individually control or monitor or manage gas lift of each of the N wells by way of managing or controlling the gas flow conditions to the respective annulus of each of the N wells which in turn sets or maintains a desired gas launch lift velocity for a given gas-liquid mixture in that well. For example, the launch point lift gas velocity control system 1300 controls the annulus injection valve 1334-1 which feeds gas to the annulus of well 1301-1 to operate the set of downhole injection valves 1333A-1, 1333B-1, and 1333C-1 which in turn set or maintain the desired gas launch lift velocity for the gas-liquid mixture 1315-1 of well 1301-1. (The operations and interactions of the downhole injection valves and annulus injection valve for each of the N wells of FIG. 13 are similar to the operations and interactions of the downhole injection valves and annulus injection valve as described in FIG. 11).

Thus, the launch point lift gas velocity control system 1300 provides for a dynamic adjustment to the lift gas velocity downhole for each of the N wells to maintain minimum lift conditions for a gas-liquid mixture tuned to each of the set of N wells (and also for a downhole tool such as a plunger, the downhole tool optionally installed adjacent a targeted gas-liquid mixture). The dynamic adjustment to the lift gas velocity downhole for each of the N wells is provided by regulating the injected gas flow into each annulus on a per well basis.

The exemplary systems and methods of this disclosure have been described in relation to operations involving wells. However, to avoid unnecessarily obscuring the present disclosure, the preceding description omits a number of known structures and devices, and other application and embodiments. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Furthermore, it should be appreciated that the various links connecting the elements can be wired or wireless links, or any combination thereof, or any other known or later developed element(s) that is capable of supplying and/or communicating data to and from the connected elements. These wired or wireless links can also be secure links and may be capable of communicating encrypted information. Transmission media used as links, for example, can be any suitable carrier for electrical signals, including coaxial cables, copper wire and fiber optics, and may take the form of acoustic or light waves, such as those generated during radio-wave and infrared data communications.

Also, while the methods have been discussed and illustrated in relation to a particular sequence of events, it should be appreciated that changes, additions, and omissions to this sequence can occur without materially affecting the operation of the disclosed embodiments, configuration, and aspects.

A number of variations and modifications of the disclosure can be used. It would be possible to provide for some features of the disclosure without providing others.

Although the present disclosure describes components and functions implemented in the aspects, embodiments, and/or configurations with reference to particular standards and protocols, the aspects, embodiments, and/or configurations are not limited to such standards and protocols. Other similar standards and protocols not mentioned herein are in existence and are considered to be included in the present disclosure. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present disclosure.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of controlling a launch point lift gas velocity of a gas-liquid mixture at a launch point location of a production string of a well casing, the method comprising:

identifying the launch point location within the production string, the production string disposed within a well bore and configured to allow the gas-liquid mixture to travel within the production string, the production tubing string in fluid communication with a hydrocarbon deposit and having a set of well parameters comprising a first set of well parameters;

providing a system control device in fluid communication with the production string and having a set of system control device settings comprising an initial system control device setting;

providing a system controller comprising a computer processor, the computer processor having machine-executable instructions operating to:

receive the first set of well parameters;

receive the initial system control device setting;

receive the launch point location;

determine a launch point lift gas velocity at the launch point location based at least on the first set of well parameters, the launch point lift gas velocity enabling the gas-liquid mixture adjacent the launch point location to depart the launch point location;

determine an adjusted system control device setting that establishes the launch point lift gas velocity at the launch point location;

communicate the adjusted system control device setting to the system control device; and adjust the system control device to the adjusted system control device setting from the initial system control device setting; wherein:

the gas-liquid mixture adjacent the launch point location departs the launch point location as a launched gas-liquid mixture that achieves the launch point lift gas velocity.

2. The method of claim 1, wherein the launched gas-liquid mixture ascends the production string without further adjustment of the system control device.

3. The method of claim 1, wherein:

the production string has a first production string section and a second production string section;

the first production string section is associated with a wellhead portion of the production string and the second production string section is associated with a bottom hole assembly;

the launch point location is within the second production string section; and the launched gas-liquid mixture ascends the production string from the second production string section to the first production string section without further adjustment of the system control device.

4. The method of claim 1, wherein:

the system control device is an annulus injection valve regulating gas injection into a production string annular space; and the production string is one of a tubing string and a casing string.

5. The method of claim 4, wherein the set of system control device settings determine a set of system control valve flow rates for a plurality of system control valves.

6. The method of claim 1, wherein the set of well parameters include at least one of a production string inner diameter, a production string pressure, a line pressure, a gas rate, a liquid/gas ratio, and a depth to a bottom hole assembly.

7. The method of claim 3, wherein the set of well parameters include at least one of a pressure in the first production string section, a pressure in the second production string section, and a bottom hole pressure.

8. The method of claim 1, further comprising the steps of:

providing a downhole tool operating within the production string, the downhole tool having a set of downhole tool parameters; and positioning the downhole tool adjacent or within the gas-liquid mixture.

9. The method of claim 8, wherein:

the downhole tool ascends the production string without further adjustment of the system control device.

10. The method of claim 1, wherein:

the launch point location is at a distal location of the production string substantial near the terminus of the production string;

the launched gas-liquid mixture ascends the production string without further adjustment of the system control device; and the system control device is a system control valve.

11. A launch point lift gas velocity control system comprising:

a system controller comprising a system processor, the system controller operating to control a launch point lift gas velocity of a gas-liquid mixture at a launch point location of a production string of a well casing, the gas-liquid mixture disposed within a production string fitted within a well bore, the production string configured to allow the gas-liquid mixture to travel within the production string, the production string in fluid communication with a hydrocarbon deposit and having a set of well parameters comprising a first set of well parameters; and a system control device in fluid communication with the production string and having a set of system control device settings comprising an initial system control device setting, the system control device controlled by the system controller;

wherein, upon identification of the launch point location within the production string, the system processor executes machine-executable instructions to:

receive the first set of well parameters;

receive the initial system control device setting;

receive the launch point location;

determine a launch point lift gas velocity at the launch point location based at least on the first set of well parameters, the launch point lift gas velocity enabling the gas-liquid mixture adjacent the launch point location to depart the launch point location;

determine an adjusted system control device setting that establishes the launch point lift gas velocity at the launch point location;

communicate the adjusted system control device setting to the system control device; and adjust the system control device to the adjusted system control device setting from the initial system control device setting; wherein:

the gas-liquid mixture adjacent the launch point location departs the launch point location as a launched gas-liquid mixture that achieves the launch point lift gas velocity.

12. The system of claim 11, wherein the launched gas-liquid mixture ascends the production string without further adjustment of the system control device.

13. The system of claim 11, wherein:

the production string has a first production string section and a second production string section;

the first production string section is associated with a wellhead portion of the production string and the second production string section is associated with a bottom hole assembly;

the launch point location is within the second production string section; and the launched gas-liquid mixture ascends the production string from the second production string section to the first production string section without further adjustment of the system control device.

14. The system of claim 11 wherein:

the system control device is an annulus injection valve regulating gas injection into a production string annular space; and the production string is one of a tubing string and a casing string.

15. The system of claim 14, wherein the set of system control device settings determine a set of system control valve flow rates for a plurality of system control valves.

16. The system of claim 11, wherein the set of well parameters include at least one of a production string inner diameter, a production string pressure, a line pressure, a gas rate, a liquid/gas ratio, and a depth to a bottom hole assembly.

17. The system of claim 11, wherein the production string is further configured to engage a downhole tool operating within the production string, the downhole tool having a set of downhole tool parameters and positioned adjacent or within the gas-liquid mixture.

18. The system of claim 17, wherein:

the downhole tool ascends the production string without further adjustment of the system control device.

19. The system of claim 11, wherein:

the launch point location is at a distal location of the production string substantial near the terminus of the production string;

the launched gas-liquid mixture ascends the production string without further adjustment of the system control device; and the system control device is a system control valve.

20. A launch point lift gas velocity control system comprising:

a system controller comprising a system processor, the system controller operating to control a launch point lift gas velocity of a sequence of gas-liquid mixtures at a launch point location of a production string of a well casing, the sequence of gas-liquid mixtures disposed within a production string fitted within a well bore, the production string configured to allow the sequence of gas-liquid mixtures to travel within the production string, the production string in fluid communication with a hydrocarbon deposit and having a set of well parameters comprising a first set of well parameters and having a first production string section associated with a wellhead portion of the production string; and a system control device in fluid communication with the production string and having an initial system control device setting, the system control device controlled by the system controller;

wherein, upon identification of the launch point location within the production string, the system processor executes machine-executable instructions to:

receive the first set of well parameters;

receive the initial system control device setting;

receive the launch point location;

determine a first launch point lift gas velocity at the launch point location based at least on the first set of well parameters, the first launch point lift gas velocity enabling a first gas-liquid mixture of the sequence of gas-liquid mixtures adjacent the launch point location to depart the launch point location;

determine a first adjusted system control device setting that establishes the first launch point lift gas velocity at the launch point location;

communicate the first adjusted system control device setting to the system control device; and adjust the system control device to the first adjusted system control device setting from the initial system control device setting;

wherein:

the first gas-liquid mixture adjacent the launch point location departs the launch point location as a first launched gas-liquid mixture that achieves the first launch point lift gas velocity;

upon the first launched gas-liquid mixture reaching the first production string section, the system processor executes machine-executable instructions to:

determine a second launch point lift gas velocity at the launch point location, the second launch point lift gas velocity enabling a second gas-liquid mixture of the sequence of gas-liquid mixtures adjacent the launch point location to depart the launch point location;

determine a second adjusted system control device setting that establishes the second launch point lift gas velocity at the launch point location;

communicate the second adjusted system control device setting to the system control device; and adjust the system control device to the second adjusted system control device setting;

wherein:

the second gas-liquid mixture adjacent the launch point location departs the launch point location as a second launched gas-liquid mixture that achieves the second launch point lift gas velocity.

21. The system of claim 20, wherein:

the system processor executes machine-executable instructions to:

periodically determine revised launch point lift gas velocity at the launch point location, the revised launch point lift gas velocity enabling a subsequent gas-liquid mixture of the sequence of gas-liquid mixtures adjacent the launch point location to depart the launch point location;

determine a revised adjusted system control device setting that establishes the revised launch point lift gas velocity at the launch point location;

communicate the revised adjusted system control device setting to the system control device; and adjust the system control device to the revised adjusted system control device setting;

wherein:

the subsequent gas-liquid mixture adjacent the launch point location departs the launch point location as a subsequent launched gas-liquid mixture that achieves the revised launch point lift gas velocity.

* * * * *